US009163550B2

(12) United States Patent
Kumagai

(10) Patent No.: US 9,163,550 B2
(45) Date of Patent: Oct. 20, 2015

(54) INTERNAL COMBUSTION ENGINE AND STRADDLE-TYPE VEHICLE INCLUDING THE SAME

(71) Applicant: YAMAHA HATSUDOKI KABUSHIKI KAISHA, Iwata-shi, Shizuoka (JP)

(72) Inventor: Satoshi Kumagai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 34 days.

(21) Appl. No.: 13/744,661

(22) Filed: Jan. 18, 2013

(65) Prior Publication Data

US 2013/0186352 A1 Jul. 25, 2013

(30) Foreign Application Priority Data

Jan. 24, 2012 (JP) ..... 2012-012230

(51) Int. Cl.

| | |
|---|---|
| ***F01P 5/04*** | (2006.01) |
| ***F01P 1/00*** | (2006.01) |
| ***F01P 11/10*** | (2006.01) |
| *F01P 7/04* | (2006.01) |
| *F01P 7/08* | (2006.01) |
| *F01P 5/12* | (2006.01) |
| *F01P 1/02* | (2006.01) |

(52) U.S. Cl.

CPC . *F01P 1/00* (2013.01); *F01P 11/10* (2013.01); *F01P 5/04* (2013.01); *F01P 5/12* (2013.01); *F01P 7/046* (2013.01); *F01P 7/084* (2013.01); *F01P 2001/026* (2013.01); *F01P 2025/66* (2013.01); *F01P 2050/16* (2013.01)

(58) Field of Classification Search

CPC ..... F01P 5/04; F01P 7/046; F01P 7/084; F01P 2025/66; F01P 5/12

USPC ..... 123/41.11

See application file for complete search history.

(56) References Cited

U.S. PATENT DOCUMENTS

2004/0139728 A1* 7/2004 Tanabe et al. ..... 60/274
2008/0220693 A1* 9/2008 Cuisinier ..... 446/473

(Continued)

FOREIGN PATENT DOCUMENTS

CN 1467368 A 1/2004
CN 1532384 A 9/2004

(Continued)

OTHER PUBLICATIONS

Kumagai, "Internal Combustion Engine and Straddle-Type Vehicle Including the same", U.S. Appl. No. 13/744,673, filed Jan. 18, 2013.

(Continued)

*Primary Examiner* — Lindsay Low
*Assistant Examiner* — Charles Brauch
(74) *Attorney, Agent, or Firm* — Keating & Bennett, LLP

(57) ABSTRACT

A forced air-cooled engine includes a crankcase, a cylinder block, a cylinder head, a cooling fan, and a shroud arranged to cover a portion of the crankcase, the cooling fan, and a portion of the cylinder block and a portion of the cylinder head. Fins are provided at least in a region of the cylinder block covered by the shroud. The shroud includes a facing wall portion that faces the fins. An exhaust opening is provided between the facing wall portion and the cylinder block, and opens away from the cooling fan.

15 Claims, 14 Drawing Sheets

(56) References Cited

U.S. PATENT DOCUMENTS

| | | | | |
|---|---|---|---|---|
| 2009/0211554 | A1* | 8/2009 | Tabata et al. | 123/435 |
| 2009/0293835 | A1* | 12/2009 | Nakamizo | 123/198 E |
| 2009/0301413 | A1 | 12/2009 | Ogawa et al. | |
| 2010/0130320 | A1* | 5/2010 | Kitano et al. | 474/110 |

FOREIGN PATENT DOCUMENTS

| | | | |
|---|---|---|---|
| CN | 101151443 | A | 3/2008 |
| CN | 101598046 | A | 12/2009 |
| CN | 101634243 | A | 1/2010 |
| EP | 1 369 560 | A2 | 12/2003 |
| JP | 2008-157222 | A | 7/2008 |

OTHER PUBLICATIONS

Official Communication issued in corresponding Chinese Patent Application No. 201310027469.X, mailed on Nov. 4, 2014.

Official Communication issued in corresponding Chinese Patent Application No. 201310027469.X, mailed on Jun. 25, 2015.

* cited by examiner

INTERNAL COMBUSTION ENGINE AND STRADDLE-TYPE VEHICLE INCLUDING THE SAME

BACKGROUND OF THE INVENTION

1. Field of the Invention

The present invention relates to internal combustion engines and straddle-type vehicles including the internal combustion engines.

2. Description of the Related Art

A conventionally known internal combustion engine (hereinafter referred to as an engine) of a vehicle such as a motorcycle includes a shroud for covering a portion of the engine, and a cooling fan for supplying air to inside of the shroud (see JP-A-2008-157222, for example). In such an engine, the cooling fan produces a flow of air inside the shroud. Thus, a portion of the engine is cooled by the air. This type of engine is idiomatically referred to as a "forced air-cooled engine".

JP-A-2008-157222 discloses an air guide cover surrounding the entire peripheries of a cylinder block and a cylinder head of an engine, and a fan for introducing air to inside of the air guide cover. The cylinder block and the cylinder head are provided with fins. In a lower wall of the air guide cover, there is formed a cooling air outlet through which air inside the air guide cover is discharged downward. The air introduced into the air guide cover is divided into air flowing through a region above the cylinder block and the cylinder head, air flowing through a region rightward of the cylinder block and the cylinder head, air flowing through a region leftward of the cylinder block and the cylinder head, and air flowing through a region below the cylinder block and the cylinder head. The divided air, flowing through the region above the cylinder block and the cylinder head, reaches the region below the cylinder block and the cylinder head via the region rightward or leftward of the cylinder block and the cylinder head, and is then discharged downward through the cooling air outlet.

However, in the above-described conventional technique, the air guide cover covers the entire peripheries of the cylinder block and the cylinder head, and the air guide cover is thus increased in size, resulting in an increase in size of the engine.

SUMMARY OF THE INVENTION

Preferred embodiments of the present invention provide a forced air-cooled engine that prevents an increase in size while ensuring efficient cooling of the engine.

An internal combustion engine according to a preferred embodiment of the present invention includes a crankshaft; a crankcase supporting the crankshaft; a cylinder block connected to the crankcase and including a cylinder provided therein; a cylinder head superposed on the cylinder block so as to cover the cylinder; a cooling fan rotated together with the crankshaft; and a shroud arranged to cover a portion of the crankcase, the cooling fan, a portion of the cylinder block, and a portion of the cylinder head. At least in a region of the cylinder block covered by the shroud, there are provided a plurality of fins. The shroud includes a facing wall portion facing the fins. Between the facing wall portion and the cylinder block, an exhaust opening that opens away from the cooling fan is provided.

In the internal combustion engine, air flowing between the facing wall portion of the shroud and the cylinder block is discharged away from the cooling fan through the exhaust opening, with the flow direction of the air remaining unchanged. Therefore, air can be smoothly discharged, and air resistance can be reduced. Thus, air can be efficiently supplied, and cooling of the internal combustion engine can be enhanced. At least in a region where the exhaust opening is located, the cylinder block is not covered, which means that the cylinder block is not entirely covered, thus making it possible to reduce the shroud in size and to prevent an increase in size of the resulting engine. Note that air is not supplied to a lateral region of the cylinder block located away from the cooling fan, and thus cooling performance for this region is degraded. However, the flow of air is smoothed, thus enhancing cooling performance for the other regions of the cylinder block. As a result, degradation in cooling performance is prevented on the whole, or cooling performance is enhanced on the whole.

According to a preferred embodiment of the present invention, the cooling fan is preferably connected to one end of the crankshaft. The exhaust opening preferably opens away from the cooling fan in a direction parallel or substantially parallel to the crankshaft.

Thus, air supplied from the cooling fan can be discharged away from the cooling fan in the direction parallel or substantially parallel to the crankshaft. As a result, the flow of air inside the shroud can be smoothed.

According to another preferred embodiment of the present invention, the crankshaft preferably extends rightward and leftward. The cooling fan is preferably located rightward of the crankcase and a left surface of the cylinder block is preferably not covered by the shroud, or the cooling fan is preferably located leftward of the crankcase and a right surface of the cylinder block is preferably not covered by the shroud. Thus, the shroud can be reduced in size.

According to still another preferred embodiment of the present invention, the crankshaft preferably extends rightward and leftward. The cooling fan is preferably located rightward of the crankcase and the exhaust opening is preferably located leftward of an axis of the cylinder, or the cooling fan is preferably located leftward of the crankcase and the exhaust opening is preferably located rightward of the cylinder axis. Thus, air inside the shroud flows from a position rightward of the cylinder axis to a position leftward of the cylinder axis or from a position leftward of the cylinder axis to a position rightward of the cylinder axis. Air is supplied not only to a region located in the vicinity of the cooling fan but also to a region located away from the cooling fan, thus preventing degradation in cooling performance.

According to yet another preferred embodiment of the present invention, the cooling fan is preferably connected to one end of the crankshaft. A region of the crankshaft located toward the other end thereof is preferably connected with a cam chain located inside the cylinder block and the cylinder head. A cam chain tensioner that applies tension to the cam chain and is partially exposed to outside of the cylinder block is preferably inserted into the cylinder block. The exhaust opening is preferably located closer to the cylinder head than the cam chain tensioner.

A region of the engine located closer to the cylinder head than the cam chain tensioner is likely to reach a high temperature. However, the region of the engine, which is likely to reach a high temperature, can be efficiently cooled.

According to still yet another preferred embodiment of the present invention, in the cylinder block, there is preferably located a sensor that detects a state of the engine. The exhaust opening is preferably located closer to the cylinder head than the sensor.

A region of the engine located closer to the cylinder head than the sensor is likely to reach a high temperature. However, the region of the engine, which is likely to reach a high temperature, can be efficiently cooled. Furthermore, the sensor can be prevented from being influenced by heat.

According to another preferred embodiment of the present invention, the cylinder head preferably includes an intake port and an exhaust port. The shroud preferably includes a shroud main body arranged to cover a portion of the crankcase, a portion of the cylinder block and a portion of the cylinder head. The facing wall portion preferably includes an intake-side facing wall portion extending toward the intake port of the cylinder head from the shroud main body, and an exhaust-side facing wall portion extending toward the exhaust port of the cylinder head from the shroud main body. A width of an exhaust opening of the intake-side facing wall portion and a width of an exhaust opening of the exhaust-side facing wall portion are preferably different from each other.

The widths of the exhaust openings of the intake-side facing wall portion and the exhaust-side facing wall portion are appropriately selected in accordance with temperature characteristics of the internal combustion engine, thus making it possible to perform cooling in accordance with the temperature characteristics of the internal combustion engine. The width of the exhaust opening of the intake-side facing wall portion can be made greater or smaller than that of the exhaust opening of the exhaust-side facing wall portion.

According to still another preferred embodiment of the present invention, the shroud preferably includes a shroud main body arranged to cover a portion of the crankcase, a portion of the cylinder block and a portion of the cylinder head. The facing wall portion preferably includes an upper facing wall portion extending above the cylinder block from the shroud main body, and a lower facing wall portion extending below the cylinder block from the shroud main body. A length of the upper facing wall portion from the shroud main body and a length of the lower facing wall portion from the shroud main body are different from each other.

The lengths of the upper and lower facing wall portions are appropriately selected in accordance with the temperature characteristics of the internal combustion engine, thus making it possible to perform cooling in accordance with the temperature characteristics of the internal combustion engine. For example, when an upper region of the internal combustion engine is more likely to reach a high temperature than a lower region of the internal combustion engine, the upper facing wall portion preferably has a length longer than a length of the lower facing wall portion, thus making it possible to efficiently cool the internal combustion engine.

According to yet another preferred embodiment of the present invention, the internal combustion engine preferably includes a piston connected to the crankshaft via a connecting rod and located inside the cylinder so as to be movable in a reciprocating manner. The exhaust opening is preferably located closer to the cylinder head than a bottom dead center of the piston.

A region of the cylinder block located closer to the cylinder head than the bottom dead center of the piston is likely to reach a high temperature. The exhaust opening is located closer to the cylinder head than the bottom dead center of the piston, thus allowing air to be guided to this region. As a result, the cylinder block can be suitably cooled.

According to still yet another preferred embodiment of the present invention, in an upper portion of the cylinder head, there is preferably provided an intake port. The shroud preferably includes an additional facing wall portion facing at least a portion of a surrounding region of the intake port of the cylinder head. Between the additional facing wall portion and the cylinder head, there is preferably provided additional exhaust opening.

Thus, air can be guided to the surrounding region of the intake port of the cylinder head. The cylinder head that is likely to reach a high temperature can be suitably cooled. Since the additional exhaust opening is formed, the total area of the exhaust openings is increased, and air resistance can be reduced.

According to another preferred embodiment of the present invention, the crankshaft preferably extends rightward and leftward. In an upper portion of the cylinder head, there is preferably provided an intake port. The intake port is preferably connected with an intake pipe. The cooling fan is preferably located rightward of the crankcase and the shroud preferably includes an additional facing wall portion facing a region of the cylinder head located rightward of the intake port, or the cooling fan is preferably located leftward of the crankcase and the shroud preferably includes an additional facing wall portion facing a region of the cylinder head located leftward of the intake port. Between the additional facing wall portion and the cylinder head, there is preferably provided an additional exhaust opening.

Thus, air can be guided to a surrounding region of the intake port of the cylinder head. The cylinder head, which is likely to reach a high temperature, can be suitably cooled. Since the additional exhaust opening is provided, the total area of the exhaust openings is increased, and air resistance can be reduced. Furthermore, the shroud can be reduced in size.

According to still another preferred embodiment of the present invention, in a lower portion of the cylinder head, there is preferably provided an exhaust port. The shroud preferably includes an additional facing wall portion facing at least a portion of a surrounding region of the exhaust port of the cylinder head. Between the additional facing wall portion and the cylinder head, there is preferably provided an additional exhaust opening.

Thus, air can be guided to the surrounding region of the exhaust port of the cylinder head. The cylinder head, which is likely to reach a high temperature, can be suitably cooled. Since the additional exhaust opening is provided, the total area of the exhaust openings is increased, and air resistance can be reduced.

According to yet another preferred embodiment of the present invention, the crankshaft preferably extends rightward and leftward. In a lower portion of the cylinder head, there is preferably provided an exhaust port. The exhaust port is preferably connected with an exhaust pipe. The cooling fan is preferably located rightward of the crankcase and the shroud preferably includes an additional facing wall portion facing a region of the cylinder head located rightward of the exhaust port, or the cooling fan is preferably located leftward of the crankcase and the shroud preferably includes an additional facing wall portion facing a region of the cylinder head located leftward of the exhaust port. Between the additional facing wall portion and the cylinder head, there is preferably provided an additional exhaust opening.

Thus, air can be guided to a surrounding region of the exhaust port of the cylinder head. The cylinder head, which is likely to reach a high temperature, can be suitably cooled. Since the additional exhaust opening is provided, the total area of the exhaust openings is increased, and air resistance can be reduced. Furthermore, the shroud can be reduced in size.

According to still yet another preferred embodiment of the present invention, a distance between the facing wall portion and the fins is preferably smaller than an interval between the fins facing the facing wall portion. Thus, a flow velocity of air between the facing wall portion and the fins can be increased, and cooling efficiency of air can be enhanced.

A straddle-type vehicle according to yet another preferred embodiment of the present invention includes an internal combustion engine according to one of the preferred embodiments of the present invention described above. Thus, the above-described effects are obtainable in the straddle-type vehicle.

Various preferred embodiments of the present invention provide a forced air-cooled engine that effectively prevents an increase in size while ensuring efficient cooling of the engine.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

Figure 1:
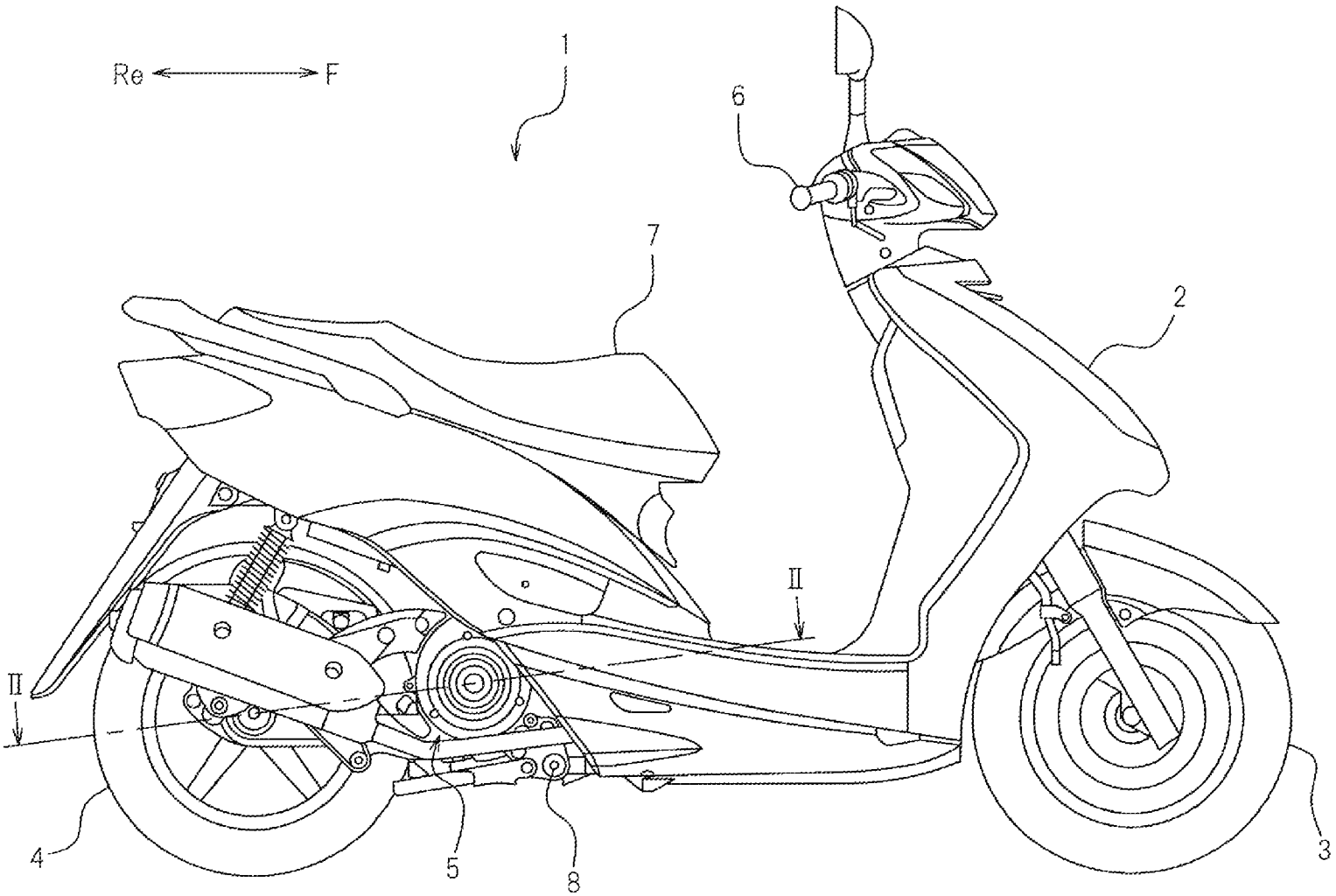
FIG. 1 is a right side view of a motorcycle according to a first preferred embodiment of the present invention.

As illustrated in FIG. 1, a straddle-type vehicle according to the present preferred embodiment preferably is a scooter-type motorcycle 1, for example. The motorcycle 1 is just an example of the straddle-type vehicle according to a preferred embodiment of the present invention, and the straddle-type vehicle according to the present invention is not limited to the scooter-type motorcycle 1. The straddle-type vehicle according to the present invention may be any other type of motorcycle such as a "moped-type", "off-road" or "street" motorcycle, for example. The straddle-type vehicle according to the present invention includes any vehicle that an occupant straddles when getting on the vehicle, and is not limited to a two-wheeled vehicle. The straddle-type vehicle according to the present invention may be, for example, a tricycle of a type in which a traveling direction is changed by tilting a body of the tricycle, or may be any other straddle-type vehicle such as an ATV (All Terrain Vehicle), for example.

In the following description, "front", "rear", "right" and "left" mean front, rear, right and left with respect to an occupant of the motorcycle 1, respectively. Reference signs "F", "Re", "R" and "L" used in the drawings represent front, rear, right and left, respectively.

The motorcycle 1 preferably includes a motorcycle main body 2, a front wheel 3, a rear wheel 4, and an engine unit 5 that drives the rear wheel 4. The motorcycle main body 2 preferably includes a handlebar 6 operated by the occupant, and a seat 7 on which the occupant sits. The engine unit 5 preferably is a "unit swing type" engine unit, for example. The engine unit 5 is supported by a body frame (not illustrated in FIG. 1) so as to be swingable around a pivot shaft 8. In other words, the engine unit 5 is supported by the body frame in a swingable manner.

Figure 2:
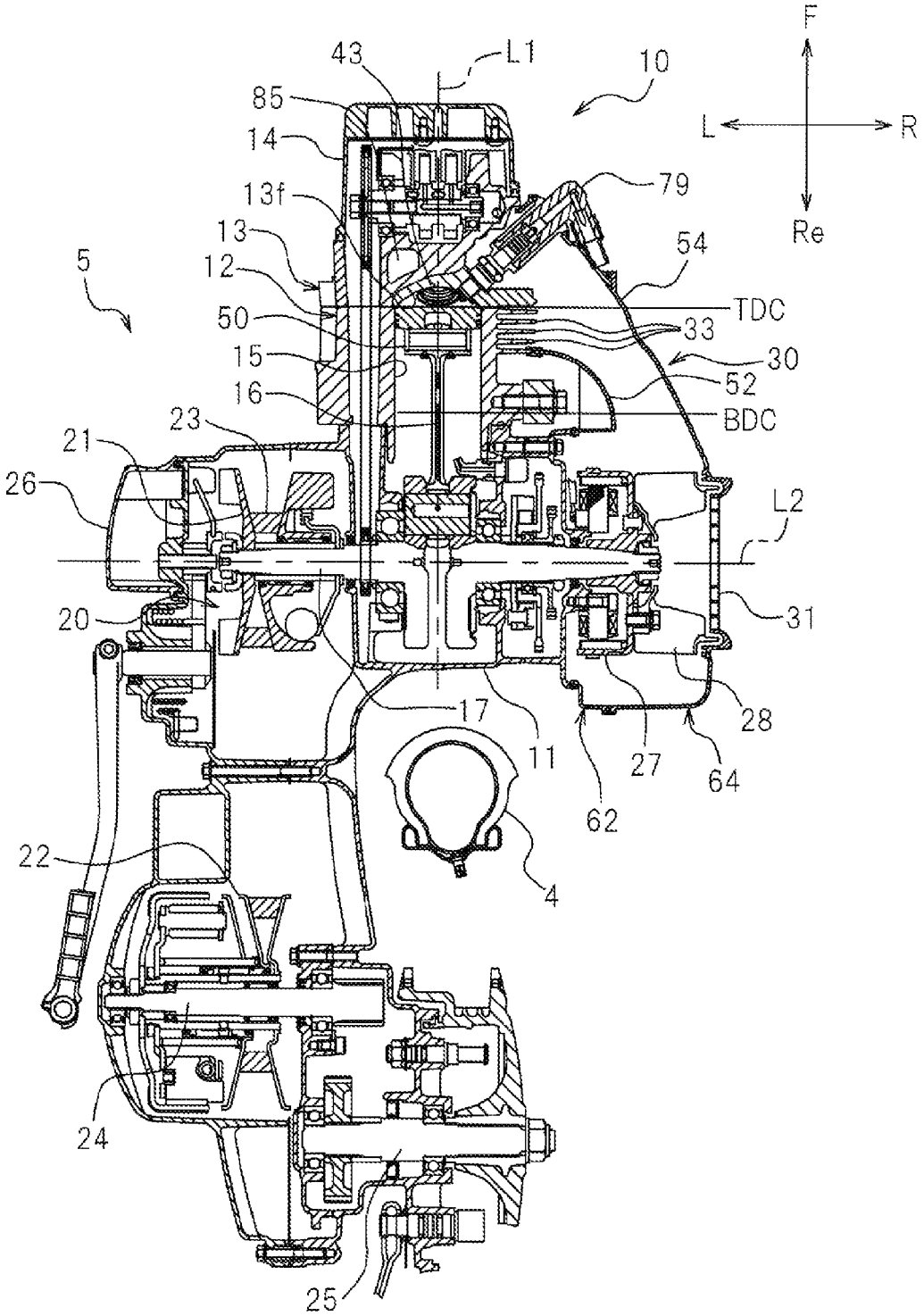
FIG. 2 is a cross-sectional view taken along the line of II-II FIG. 1.
Figure 3:
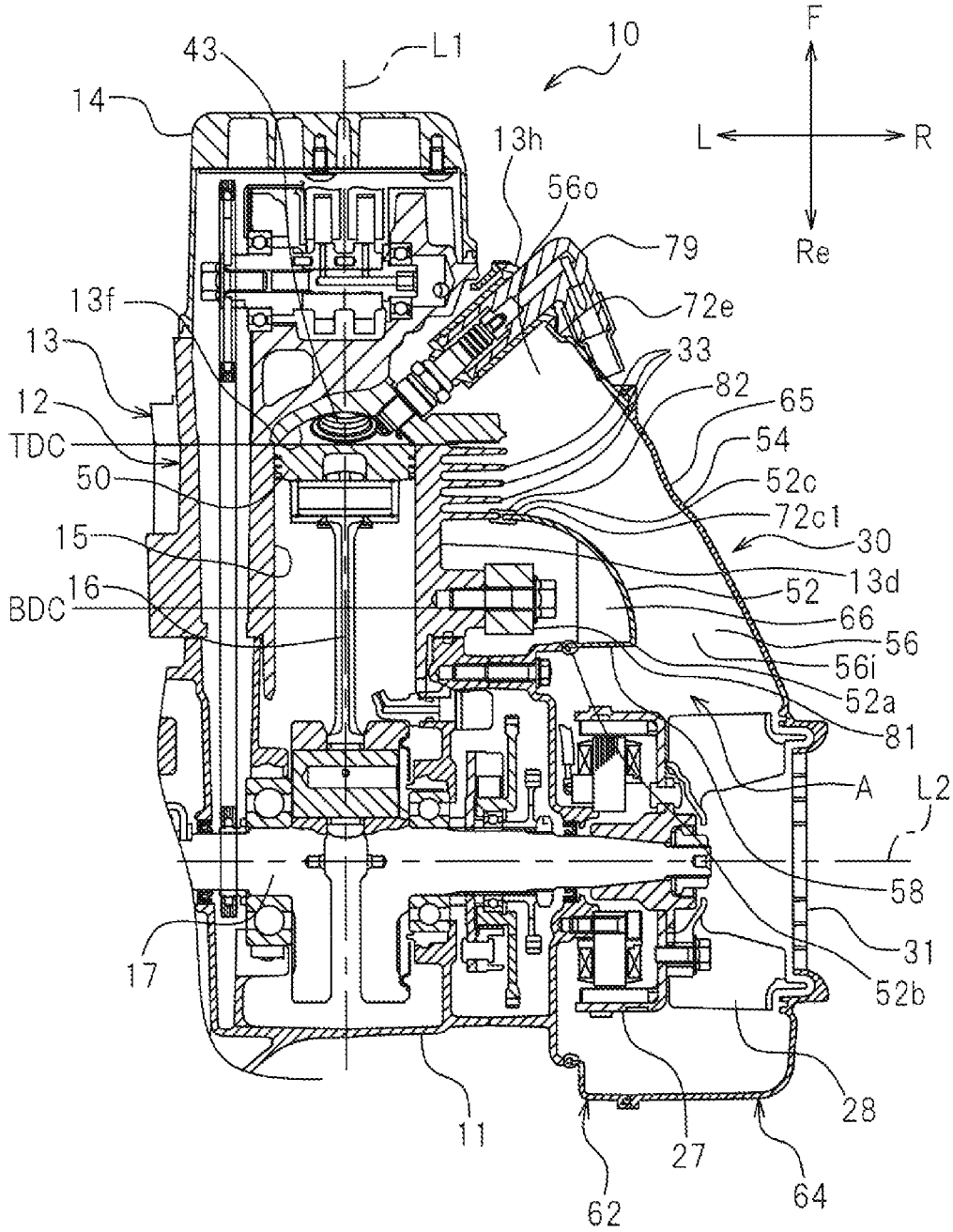
FIG. 3 is an enlarged view of a portion of the motorcycle such as a portion of an engine illustrated in FIG. 2.

FIG. 2 is a cross-sectional view taken along the line II-II of FIG. 1. FIG. 3 is an enlarged view of a portion of the motorcycle 1 such as a portion of an engine 10 illustrated in the cross-sectional view of FIG. 2. As illustrated in FIG. 2, the engine unit 5 preferably includes the engine 10 serving as an example of an internal combustion engine according to a preferred embodiment of the present invention, and a V-belt type continuously variable transmission (hereinafter referred to as a "CVT") 20. In the present preferred embodiment, the engine 10 and the CVT 20 are preferably provided in an integrated manner to form the engine unit 5. However, the engine 10 and the transmission may naturally be provided in a separate manner.

The engine 10 preferably is a single-cylinder engine equipped with a single cylinder, for example. The engine 10 preferably is a four-stroke engine that sequentially repeats an intake stroke, a compression stroke, a power stroke, and an exhaust stroke, for example. The engine 10 preferably includes a crankcase 11, a cylinder block 12 extending forward from the crankcase 11 and connected to the crankcase 11, a cylinder head 13 connected to a front portion of the cylinder block 12, and a cylinder head cover 14 connected to a front portion of the cylinder head 13. Note that as used herein, the term "forward" not only means forward in a strict sense, i.e., a direction parallel or substantially to a horizontal line, but also means a direction inclined with respect to a horizontal line. A cylinder 15 is provided inside of the cylinder block 12.

Note that the cylinder 15 may include, for example, a cylinder liner inserted into a main body of the cylinder block 12 (i.e., a region of the cylinder block 12 other than the cylinder 15), or may be formed integrally with the main body of the cylinder block 12. In other words, the cylinder 15 may be separable from the main body of the cylinder block 12 or may be inseparable from the main body of the cylinder block 12. A piston 50 is slidably provided inside of the cylinder 15. The piston 50 is located so as to be movable in a reciprocating manner between a top dead center TDC and a bottom dead center BDC.

The cylinder head 13 is superposed on the cylinder block 12 so as to cover the cylinder 15. As illustrated in FIG. 3, in the cylinder head 13, there are provided a concave region **13*f*, and intake and exhaust ports 41 and 42 (see FIG. 11) communicated with the concave region 13*f*. A top surface of the piston 50, an inner peripheral wall of the cylinder 15, and the concave region 13*f* define a combustion chamber 43. The piston 50 is connected to a crankshaft 17 via a connecting rod 16. The crankshaft 17 is extended rightward and leftward, and supported by the crankcase 11**.

In the present preferred embodiment, the crankcase 11, the cylinder block 12, the cylinder head 13 and the cylinder head cover 14 are preferably separate components, and are assembled to each other. However, these components do not necessarily have to be separate components, but may be integral with each other where appropriate. For example, the crankcase 11 and the cylinder block 12 may be integral with each other, the cylinder block 12 and the cylinder head 13 may be integral with each other, and the cylinder head 13 and the cylinder head cover 14 may be integral with each other.

As illustrated in FIG. 2, the CVT 20 preferably includes a first pulley 21 defining and functioning as a driving pulley, a second pulley 22 defining and functioning as a driven pulley, and a V belt 23 wound around the first and second pulleys 21 and 22. A left end portion of the crankshaft 17 protrudes leftward from the crankcase 11. The first pulley 21 is attached to the left end portion of the crankshaft 17. The second pulley 22 is attached to a main shaft 24. The main shaft 24 is connected to a rear axle 25 via an unillustrated gear mechanism. Note that FIG. 2 illustrates a state where a transmission ratio is changed between front side and rear side regions of the first pulley 21. The same goes for the second pulley 22. The crankcase 11 is provided at its left side with a transmission case 26. The CVT 20 is contained inside the transmission case 26.

The crankshaft 17 is provided at its right portion with a generator 27. At a right end portion of the crankshaft 17, a cooling fan 28 is fixed. The cooling fan 28 is rotated together with the crankshaft 17. The cooling fan 28 is arranged so as to suck air leftward by being rotated. The crankcase 11, the cylinder block 12 and the cylinder head 13 are provided with a shroud 30. The generator 27 and the cooling fan 28 are contained inside the shroud 30. A specific structure of the shroud 30 will be described later.

Figure 4:
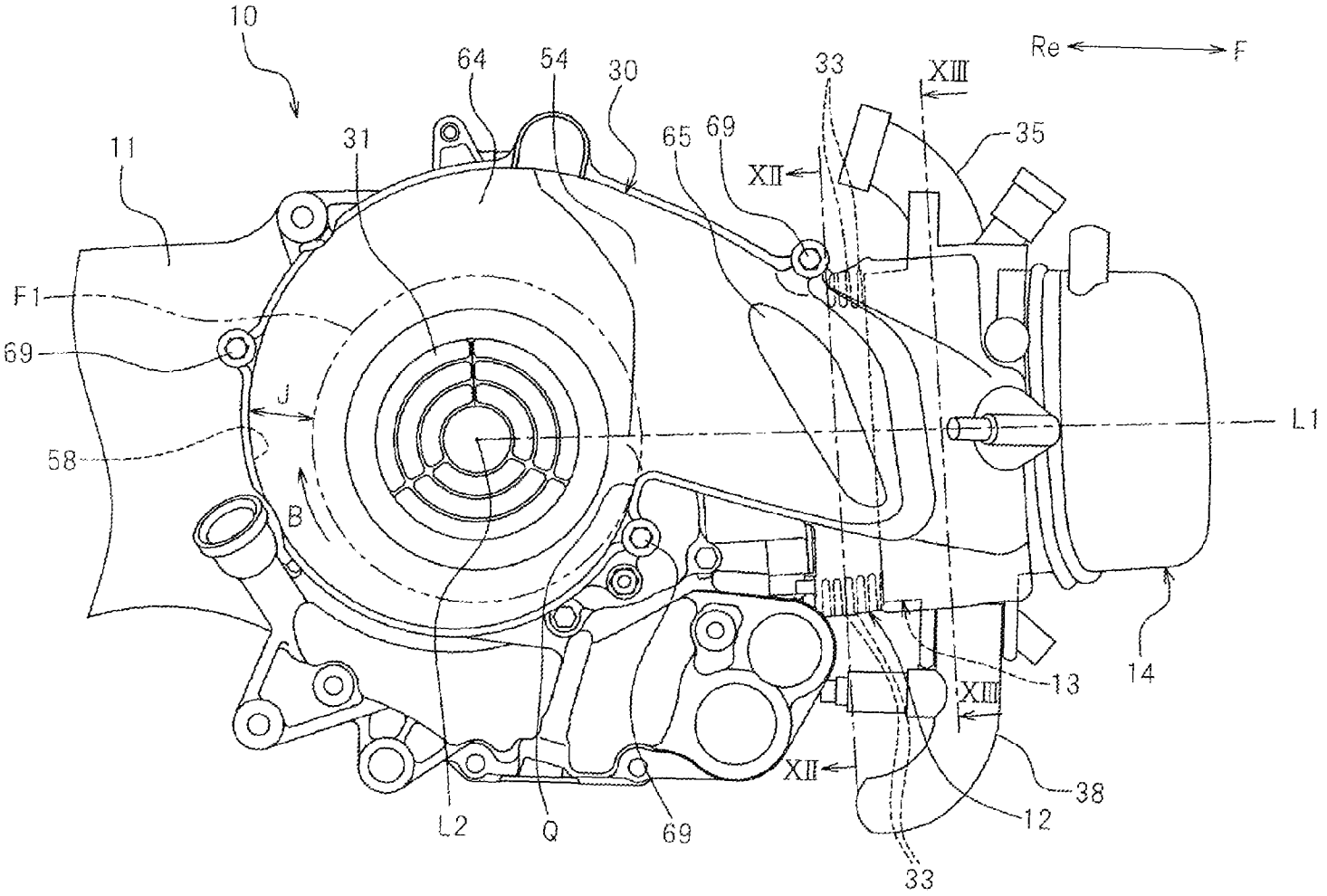
FIG. 4 is a right side view of a portion of the engine according to the first preferred embodiment of the present invention.

FIG. 4 is a right side view of a portion of the engine 10. As illustrated in FIG. 4, the engine 10 according to the present preferred embodiment preferably is a "transverse" engine in which the cylinder block 12 and the cylinder head 13 extend in a horizontal direction or in a direction inclined slightly upward toward the front with respect to the horizontal direction. The reference sign "L1" represents a line passing through a center of the cylinder 15 (see FIG. 2). Hereinafter, this line will be referred to as a "cylinder axis L1". The cylinder axis L1 extends in a horizontal direction or in a direction inclined slightly with respect to the horizontal direction. However, the direction of the cylinder axis L1 is not limited to any particular direction. For example, the cylinder axis L1 may have an inclination angle of about 0° to about 15° or an inclination angle of about 15° or more with respect to a horizontal plane. The cylinder head 13 is connected at its upper portion with an intake pipe 35. The cylinder head 13 is connected at its lower portion with an exhaust pipe 38. Inside the cylinder head 13, the intake and exhaust ports 41 and 42 (see FIG. 11) are provided. The intake pipe 35 is connected to the intake port 41, and the exhaust pipe 38 is connected to the exhaust port 42. The intake and exhaust ports 41 and 42 are provided with intake and exhaust valves 41A and 42A (see FIG. 11), respectively.

The engine 10 according to the present preferred embodiment preferably is an air-cooled engine cooled by air. As illustrated in FIG. 2, a plurality of cooling fins 33 is provided in the cylinder block 12. Note that the fins 33 may also be provided in component(s) other than the cylinder block 12. For example, the fins 33 may also be provided in the cylinder head 13 and/or the crankcase 11. The engine 10 may be entirely cooled by air. Alternatively, the engine 10 may be partially cooled by cooling water even though the engine 10 includes the cooling fins 33. In other words, the engine 10 may be partially cooled by air and partially cooled by cooling water.

A specific shape of each fin 33 is not limited to any particular shape, but in the engine 10 according to the present preferred embodiment, each fin 33 preferably has the following shape. The fins 33 according to the present preferred embodiment protrude from a surface of at least a portion of the cylinder block 12 and cylinder head 13, and extend in a direction perpendicular or substantially perpendicular to the cylinder axis L1. In other words, the fins 33 extend in a direction perpendicular or substantially perpendicular to the surface of the cylinder block 12 or the cylinder head 13. The fins 33 are arranged along the direction of the cylinder axis L1. The fins 33 adjacent to each other have an interval therebetween. The fins 33 may be arranged at regular intervals or irregular intervals.

The plurality of fins 33 preferably have equal thicknesses. Alternatively, some of the fins 33 may have different thicknesses. The thickness of each fin 33 may be uniform at any spot, or may be different at some spots. In other words, the thickness of each fin 33 may be locally different.

In the present preferred embodiment, each fin 33 preferably has a flat plate shape, and a surface of each fin 33 is a flat surface. However, each fin 33 may be curved, and the surface of each fin 33 may be a curved surface. The shape of each fin 33 is not limited to a flat plate shape, but may be any other shape such as a needle shape or a semi-spherical shape, for example. When each fin 33 has a flat plate shape, each fin 33 does not necessarily have to extend in a direction perpendicular or substantially perpendicular to the cylinder axis L1, but may extend in a direction parallel or substantially parallel to the cylinder axis L1. Alternatively, each fin 33 may extend in a direction inclined with respect to the cylinder axis L1. The plurality of fins 33 may extend in the same direction or may extend in different directions.

Figure 5:
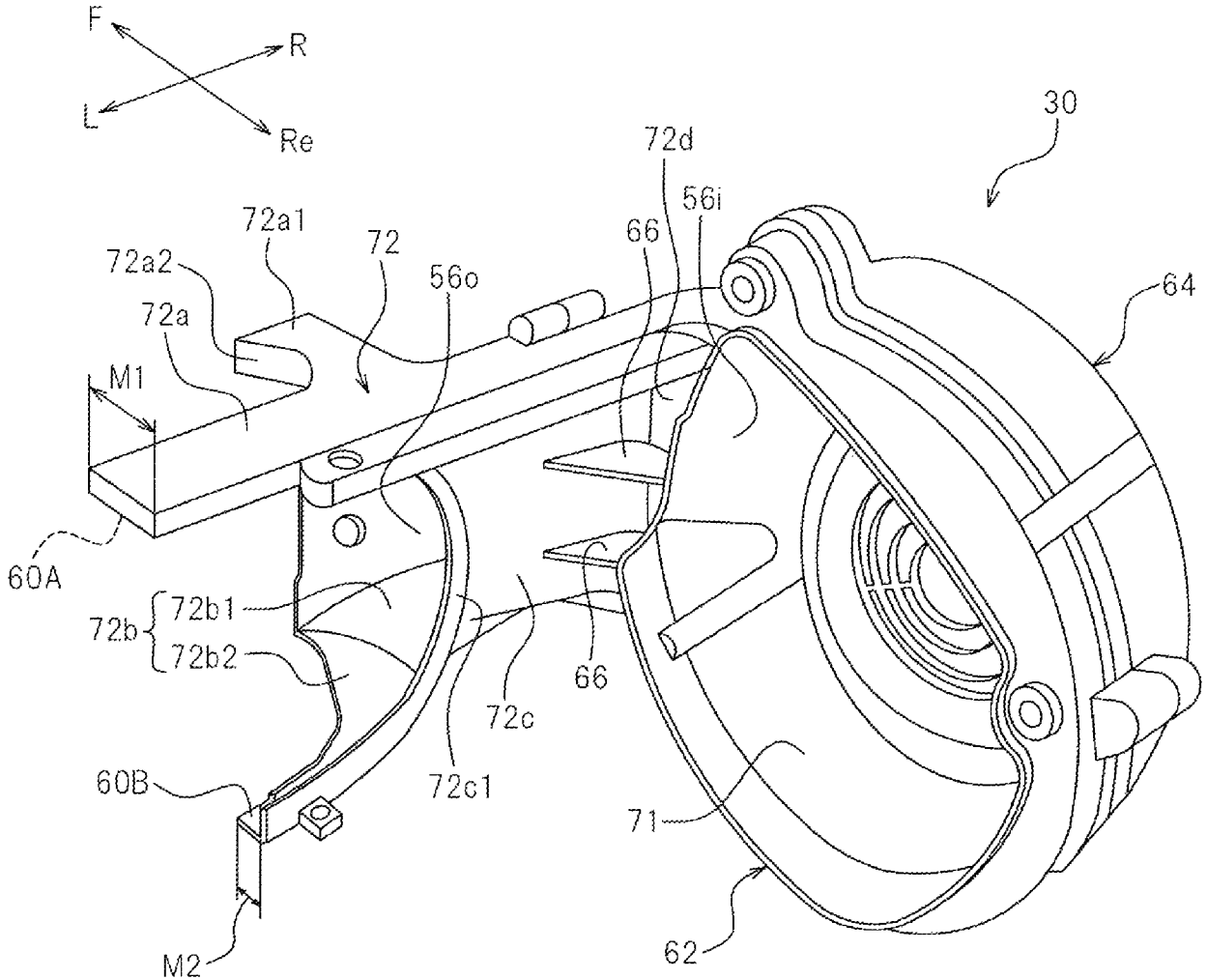
FIG. 5 is a perspective view of a shroud.
Figure 6:
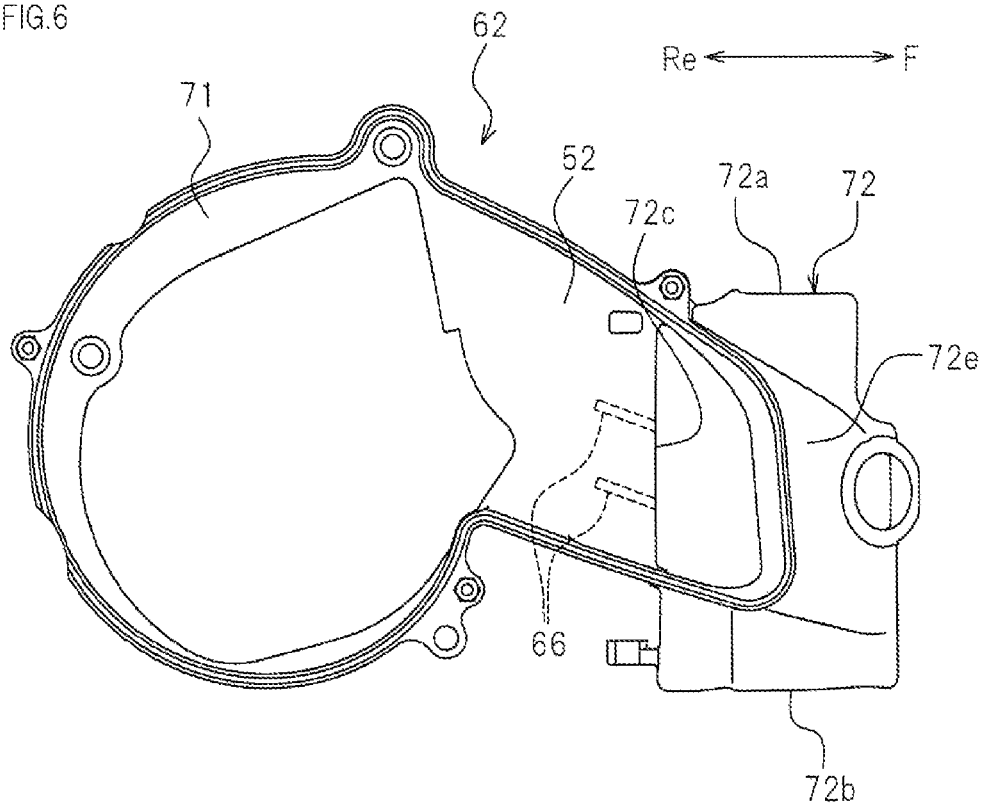
FIG. 6 is a front view of an inner member of the shroud.
Figure 7:
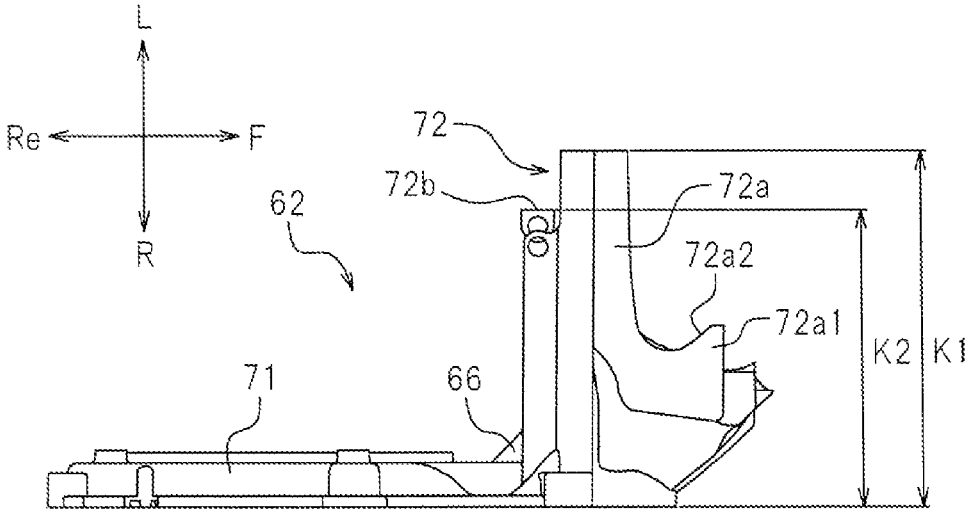
FIG. 7 is a plan view of the inner member of the shroud.
Figure 8:
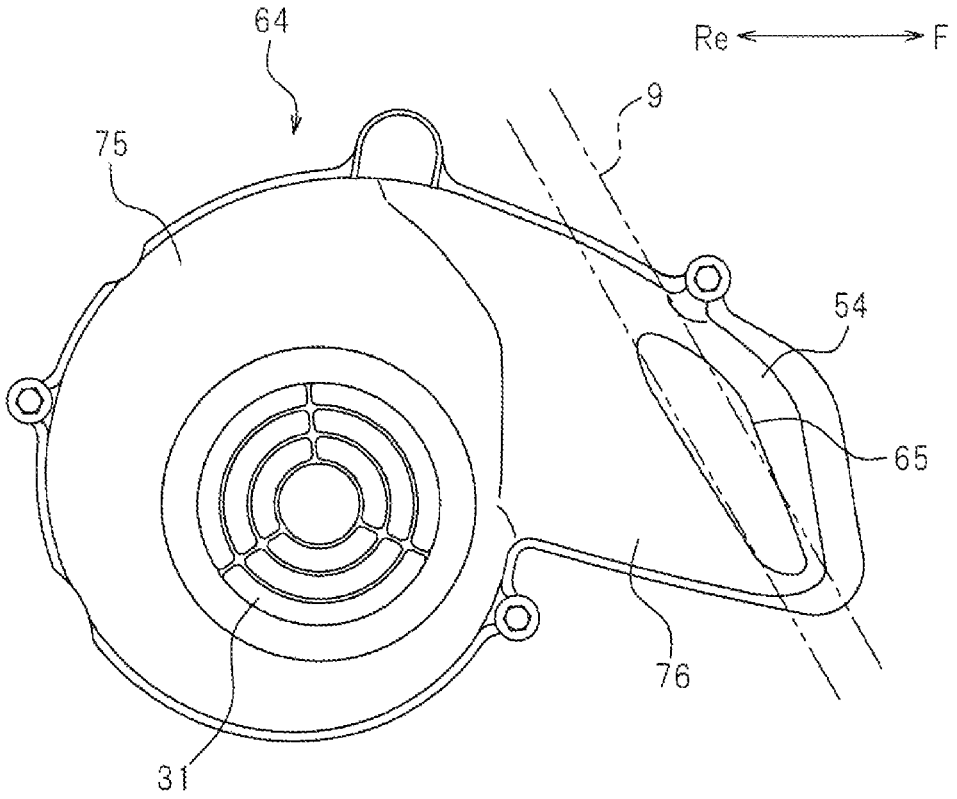
FIG. 8 is a front view of an outer member of the shroud.

Next, the specific structure of the shroud 30 will be described. FIG. 5 is a left rear perspective view of the shroud 30. The shroud 30 includes an inner member 62 and an outer member 64. The shroud 30 is formed preferably by assembling the inner and outer members 62 and 64 to each other. As illustrated in FIG. 4, the inner and outer members 62 and 64 are fixed to each other preferably with bolts 69, for example. However, the assembled structure of the inner and outer members 62 and 64 is not limited to any particular structure. FIG. 6 is a front view of the inner member 62. FIG. 7 is a plan view of the inner member 62. And FIG. 8 is a front view of the outer member 64. Note that FIGS. 6 and 8 are equivalent to right side views with respect to the vehicle. The inner and outer members 62 and 64 are each made of a synthetic resin. However, a material for each of the inner and outer members 62 and 64 is not limited to any particular material. The inner and outer members 62 and 64 may be made of the same material or may be made of different materials.

As illustrated in FIG. 7, the inner member 62 preferably is approximately L-shaped in plan view. As illustrated in FIG. 5, the inner member 62 preferably includes a substantially tubular rear portion 71, and a front portion 72 extending leftward from a front end of the rear portion 71. The front portion 72 preferably includes an inner wall 72*d* facing a lateral surface of the engine 10 (or more specifically, a right lateral surface of the cylinder block 12), and an outer wall 72*e* (see FIG. 6) facing a lateral surface of the engine 10 (or more specifically, a right lateral surface of the cylinder head 13). As illustrated in FIG. 3, in the outer wall 72*e*, there is provided a hole 13*h* into which an ignition device 79 such as an ignition plug is inserted. In the present preferred embodiment, the hole 13*h* is a round hole surrounding the entire periphery of the ignition device 79. However, the hole 13*h* may have any other shape surrounding the entire periphery of the ignition device 79. The hole 13*h* may be, for example, an arc-shaped hole surrounding portion of the periphery of the ignition device 79. As illustrated in FIG. 5, the front portion 72 preferably includes an upper wall 72*a* extending leftward from the inner and outer walls 72*d* and 72*e*, a lower wall 72*b* extending leftward from the inner and outer walls 72*d* and 72*e* and vertically facing the upper wall 72*a*, and a rear wall 72*c* extending leftward from the inner wall 72*d* and perpendicular or substantially perpendicular to the upper and lower walls 72*a* and 72*b*.

The upper wall 72*a* preferably has a horizontal plate shape extending laterally. At the upper wall 72*a*, there is provided a protrusion 72*a*1 protruding forward therefrom. A left lateral surface 72*a*2 of the protrusion 72*a*1 is curved. As illustrated in FIG. 7, the lateral surface 72*a*2 preferably is arc-shaped in plan view.

As illustrated in FIG. 5, the lower wall 72*b* preferably includes a horizontal wall 72*b*1 extending laterally, and an arc-shaped curved wall 72*b*2 extending obliquely leftward and downward from a left end portion of the horizontal wall 72*b*1.

The rear wall 72*c* extends vertically. At a left end portion of the rear wall 72*c*, there is provided an arc-shaped curved portion 72*c*1. The curved portion 72*c*1 is arranged so as to be able to come into contact with the right lateral surface, upper surface and lower surface of the cylinder block 12 of the engine 10. In the present preferred embodiment, as illustrated in FIG. 3, the curved portion 72*c*1 abuts against the fin 33 via a seal member 82. Note that the curved portion 72*c*1 may abut against the fin 33 via a buffer member, or may abut against the fin 33 via an elastic member. Alternatively, the curved portion 72*c*1 may be allowed to directly abut against the fin 33.

As illustrated in FIG. 7, a left end portion of the upper wall 72*a* is located leftward of that of the lower wall 72*b*. In other words, the upper wall 72*a* has a longitudinal length K1 longer than a longitudinal length K2 of the lower wall 72*b*. As illustrated in FIG. 5, the left end portion of the upper wall 72*a* has a width M1 wider than a width M2 of the left end portion of the lower wall 72*b*.

At a corner region defined by the inner wall 72*d* and the rear wall 72*c*, there are provided a plurality of reinforcement ribs 66. Each reinforcement rib 66 preferably has a substantially right-angled triangle horizontal plate shape. Between the reinforcement ribs 66, there may be located a sensor that detects a state of the engine 10 (e.g., a knock sensor that detects knocking of the engine 10). In the present preferred embodiment, preferably two of the reinforcement ribs 66 are provided, for example, but the number of the reinforcement ribs 66 is not limited to any particular number. The two reinforcement ribs 66 are vertically spaced apart from each other. The two reinforcement ribs 66 preferably are located parallel or substantially parallel to each other.

As illustrated in FIG. 8, the outer member 64 preferably includes a cup-shaped rear portion 75, and a front portion 76 extending forward from the rear portion 75. In the rear portion 75, a suction port 31 is provided. When the shroud 30 is attached to the engine unit 5, the suction port 31 is located at a position facing the cooling fan 28 (see FIG. 3). In the front portion 76, a recess 65 is provided. When the shroud 30 is attached to the engine unit 5, the recess 65 is located inwardly of a portion of a body frame 9 of the motorcycle 1. The recess 65 makes it possible to easily avoid interference between the shroud 30 and the body frame 9. In particular, in the motorcycle 1 according to the present preferred embodiment, the engine unit 5 is supported by the body frame 9 so as to be swingable with respect to the body frame 9, thus allowing the shroud 30 attached to the engine unit 5 to be relatively moved with respect to the body frame 9 in association with swinging movement of the engine unit 5. However, the recess 65 makes it possible to more reliably prevent contact between the shroud 30 and the body frame 9.

Figure 9:
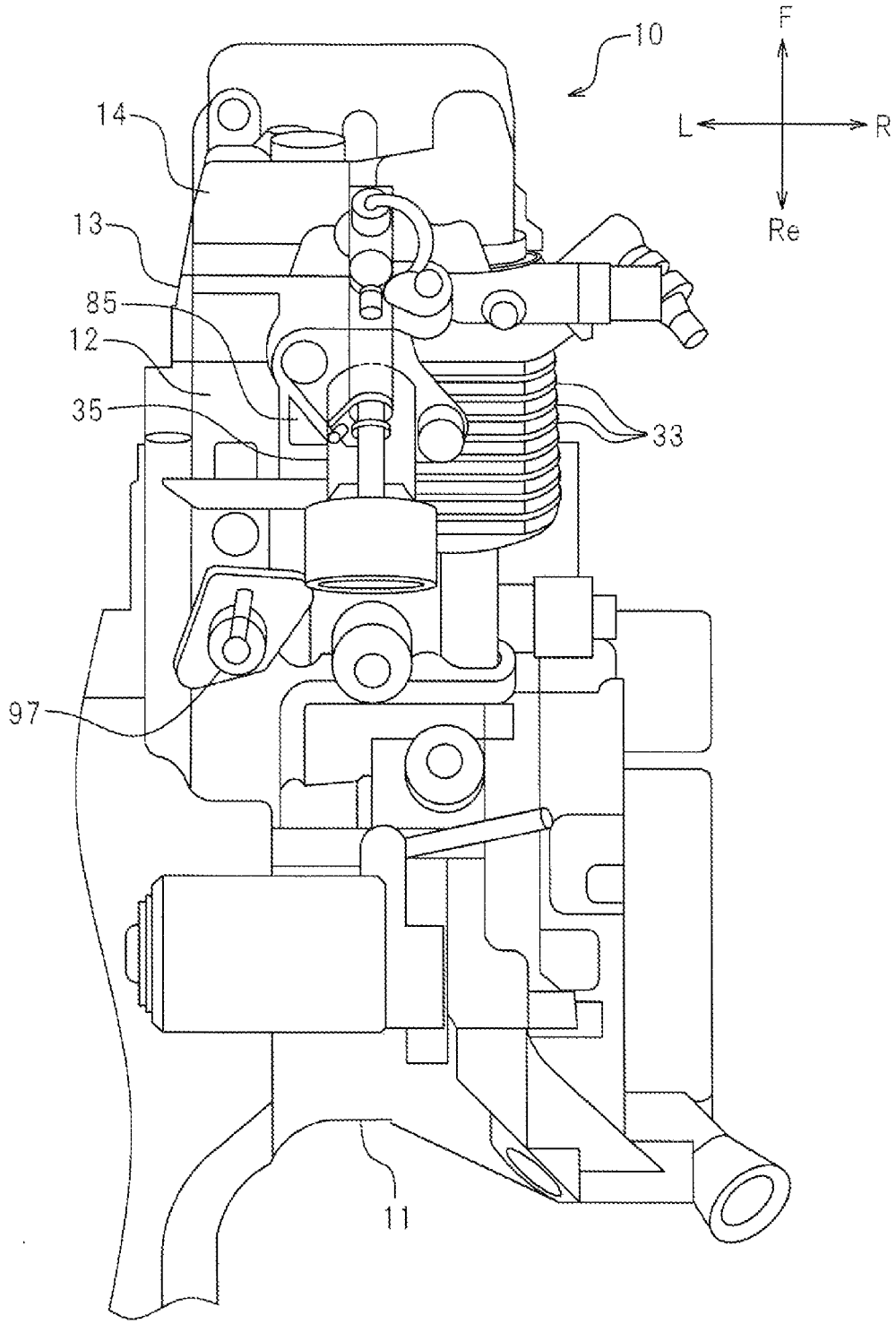
FIG. 9 is a plan view of a front portion of the engine not covered by the shroud.
Figure 10:
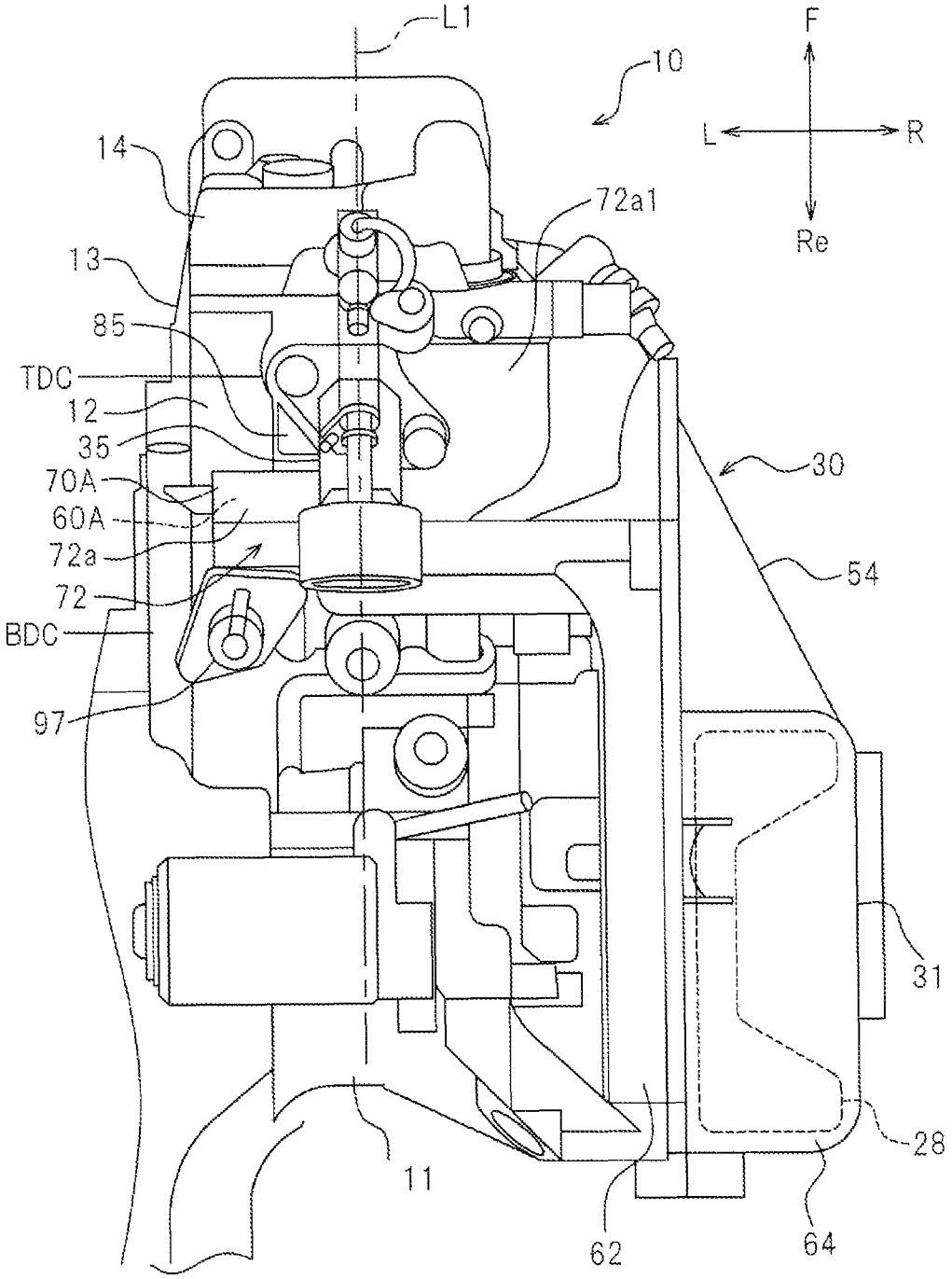
FIG. 10 is a plan view of the front portion of the engine covered by the shroud.

FIG. 9 is a plan view of a front portion of the engine 10 not covered by the shroud 30. FIG. 10 is a plan view of the front portion of the engine 10 covered by the shroud 30. As illustrated in FIG. 9, the engine 10 preferably includes the crankcase 11, the cylinder block 12, the cylinder head 13, and the cylinder head cover 14. As illustrated in FIG. 10, the shroud 30 is attached to the crankcase 11, the cylinder block 12, and the cylinder head 13. The shroud 30 extends forward along the cylinder block 12 and the cylinder head 13. A portion of the shroud 30 covers a right side region of the crankcase 11, a right side region of the cylinder block 12, and a right side region of the cylinder head 13. The other portion of the shroud 30 covers a portion of upper and lower regions of the cylinder block 12, and a portion of upper and lower regions of the cylinder head 13.

As illustrated in FIG. 10, the cooling fan 28 is located rightward of the crankcase 11, and a left surface of the cylinder block 12 is not covered by the shroud 30. The cooling fan 28 may alternatively be located leftward of the crankcase 11, and in that case, a right surface of the cylinder block 12 is not covered by the shroud 30. As illustrated in FIG. 3, inside the cylinder head 13 and the cylinder block 12, a cam chain 98 is located. The cam chain 98 is located leftward of the cylinder axis L1. When the cooling fan 28 is located leftward of the crankcase 11, the cam chain 98 may be located rightward of the cylinder axis L1. An end of an upper portion of the shroud 30, located close to the cam chain 98, is located rightward of a left end of an upper portion of the cylinder block 12. An end of a lower portion of the shroud 30, located close to the cam chain 98, is located rightward of a left end of a lower portion of the cylinder block 12.

As illustrated in FIG. 3, the generator 27 is located inside the shroud 30. The shroud 30 according to the present preferred embodiment includes an inner wall portion 52 and an outer wall portion 54. The inner wall portion 52 preferably includes the rear wall 72*c* of the front portion 72 of the inner member 62, the inner wall 72*d* (see FIG. 5) of the front portion 72 of the inner member 62, and a portion of a front side region of the rear portion 71 of the inner member 62. The outer wall portion 54 preferably includes the other portions of the inner member 62 and the outer member 64. In the present preferred embodiment, the inner wall portion 52 covers a lateral surface of a portion of the crankcase 11, and a lateral surface of a portion of the cylinder block 12. The inner wall portion 52 is located laterally of a portion of the crankcase 11 and a portion of the cylinder block 12. More specifically, the inner wall portion 52 covers a lateral surface of a portion of the crankcase 11, and a lateral surface of a region 13*d* of the cylinder block 12 where no fin 33 is provided. The inner wall portion 52 does not cover lateral surfaces of the fins 33 of the cylinder block 12. However, the location of the inner wall portion 52 according to the present preferred embodiment is described by way of example only, and may be variously changed. For example, the inner wall portion 52 may cover lateral surfaces of a portion of the fins 33 of the cylinder block 12. The inner wall portion 52 may cover at least a portion of the crankcase 11, at least a portion of the cylinder block 12, or at least a portion of the cylinder head 13. The inner wall portion 52 may be located laterally of at least a portion of the crankcase 11, at least a portion of the cylinder block 12, or at least a portion of the cylinder head 13.

When a cross section passing through a center L2 of the crankshaft 17 and parallel to the cylinder axis L1 is viewed in a direction perpendicular to the cross section, one end 52*b* of the inner wall portion 52 is located laterally of the crankcase 11. In the present preferred embodiment, the cylinder axis L1 extends substantially horizontally. Therefore, FIG. 3 can be substantially regarded as a diagram obtained when the cross section passing through the center L2 of the crankshaft 17 and parallel to the cylinder axis L1 is viewed in the direction perpendicular to the cross section. The other end 52*c* of the inner wall portion 52 is located laterally of a region of the cylinder block 12 closer to the cylinder head 13 than the bottom dead center BDC of the piston 50 (i.e., a region of the cylinder block 12 above the bottom dead center BDC of the piston 50 in FIG. 3). The other end 52*c* of the inner wall portion 52 abuts against the region of the cylinder block 12 closer to the cylinder head 13 than the bottom dead center BDC of the piston 50. The inner wall portion 52 includes the rear wall 72*c* and a portion of a longitudinal wall portion 58 described later.

The outer wall portion 54 covers the cooling fan 28, the inner wall portion 52, a portion of the crankcase 11, a portion of the cylinder block 12, and a portion of the cylinder head 13. The outer wall portion 54 is located laterally of the cooling fan 28, the inner wall portion 52, a portion of the crankcase 11, a portion of the cylinder block 12, and a portion of the cylinder head 13. Note that the outer wall portion 54 may cover the cooling fan 28, the inner wall portion 52, a portion of the crankcase 11, at least a portion of the cylinder block 12, and at least a portion of the cylinder head 13.

As mentioned above, the suction port 31 is preferably provided in the outer member 64 of the shroud 30. The suction port 31 is located rightward of the cooling fan 28. In other words, the suction port 31 is located in a region of the outer wall portion 54 facing the cooling fan 28. The inner wall portion 52 is located closer to the cylinder head 13 than the suction port 31 (i.e., above the suction port 31 in FIG. 3). When the cross section passing through the center L2 of the crankshaft 17 and parallel to the cylinder axis L1 is viewed in the direction perpendicular to the cross section, the inner wall portion 52 is protruded toward the outer wall portion 54 (i.e., rightward in FIG. 3), which means that at least a portion of the inner wall portion 52 is located closer to the outer wall portion 54 than a line connecting the ends 52*b* and 52*c* of the inner wall portion 52.

The inner and outer wall portions 52 and 54 define a duct 56 extending from the suction port 31 to reach a portion of the cylinder block 12 and a portion of the cylinder head 13. The reference signs "56*i*" and "56*o*" in FIG. 3 represent an inlet and an outlet of the duct 56, respectively (see also FIG. 5). In the present preferred embodiment, the duct 56 has no hole between the inlet 56*i* and the outlet 56*o*. That is, the duct 56 is an enclosed duct. The duct 56 serves as an air passage defined by the shroud 30. In the present preferred embodiment, the duct 56 preferably is defined only by the shroud 30. However, even when the duct 56 includes a hole between the inlet 56*i* and the outlet 56*o*, air can be guided from the inlet 56*i* to the outlet 56*o*. Therefore, the duct 56 may include a hole between the inlet 56*i* and the outlet 56*o*. For example, the duct 56 may include a sensor cooling hole or the like through which air is supplied to a component such as a knock sensor 81.

The inlet 56*i* of the duct 56 preferably includes an end 52*a* of the inner wall portion 52 located close to the cooling fan 28 and the outer wall portion 54. A region of the duct 56 located downstream of the inlet 56*i* includes a flow passage cross-sectional area smaller than that of the inlet 56*i*. In other words, between the inlet 56*i* and the outlet 56*o* of the duct 56, there is provided a region having a flow passage cross-sectional area smaller than that of the inlet 56*i*. The duct 56 is arranged so that air introduced through the inlet 56*i* is temporarily throttled, and thus the air is increased in velocity and then guided to the outlet 56*o*.

Note that as mentioned above, the recess 65 to prevent contact between the shroud 30 and the body frame 9 is preferably located in the outer member 64. Consequently, as illustrated in FIG. 3, a bottom side region of the recess 65 is bulged toward the inner wall portion 52. In a region of the duct 56 adjacent to the bottom side region of the recess 65, the duct 56 has a smaller flow passage cross-sectional area.

As mentioned above, the rear portion 71 of the inner member 62 preferably has a substantially tubular shape (see FIG. 5). The cooling fan 28 is attached to the right end portion of the crankshaft 17. The right end portion of the crankshaft 17 defines a rotation shaft of the cooling fan 28. As illustrated in FIG. 3, the inner member 62, for example, defines the longitudinal wall portion 58 surrounding a periphery of the cooling fan 28 when viewed in the direction of the rotation shaft of the cooling fan 28 (i.e., when viewed from the right or left). The longitudinal wall portion 58 may surround at least a portion of the periphery of the cooling fan 28 when viewed in the direction of the rotation shaft of the cooling fan 28. In the present preferred embodiment, the longitudinal wall portion 58 surrounds a periphery of the generator 27. However, a right side region of the longitudinal wall portion 58 may be extended rightward, and the longitudinal wall portion 58 may surround the periphery of at least a portion of the cooling fan 28. A portion of the inner wall portion 52 (i.e., a lower region of the inner wall portion 52 in FIG. 3) also serves as a portion of the longitudinal wall portion 58. The reference sign "F1" in FIG. 4 represents a virtual line schematically indicating an outer periphery of the cooling fan 28. The outer periphery of the cooling fan 28 refers to a circumferential track created by an outer peripheral end of the cooling fan 28. The longitudinal wall portion 58 is arranged so that a distance J between the longitudinal wall portion 58 and the outer periphery F1 of the cooling fan 28 is gradually increased from a reference point Q along a rotation direction B of the cooling fan 28. The reference point Q is located forward of a rotation center of the cooling fan 28 (in the present preferred embodiment, this rotation center corresponds to the center L2 of the crankshaft 17). The reference point Q is located lower than the rotation center of the cooling fan 28. The longitudinal wall portion 58 forms a "spiral casing".

Figure 11:
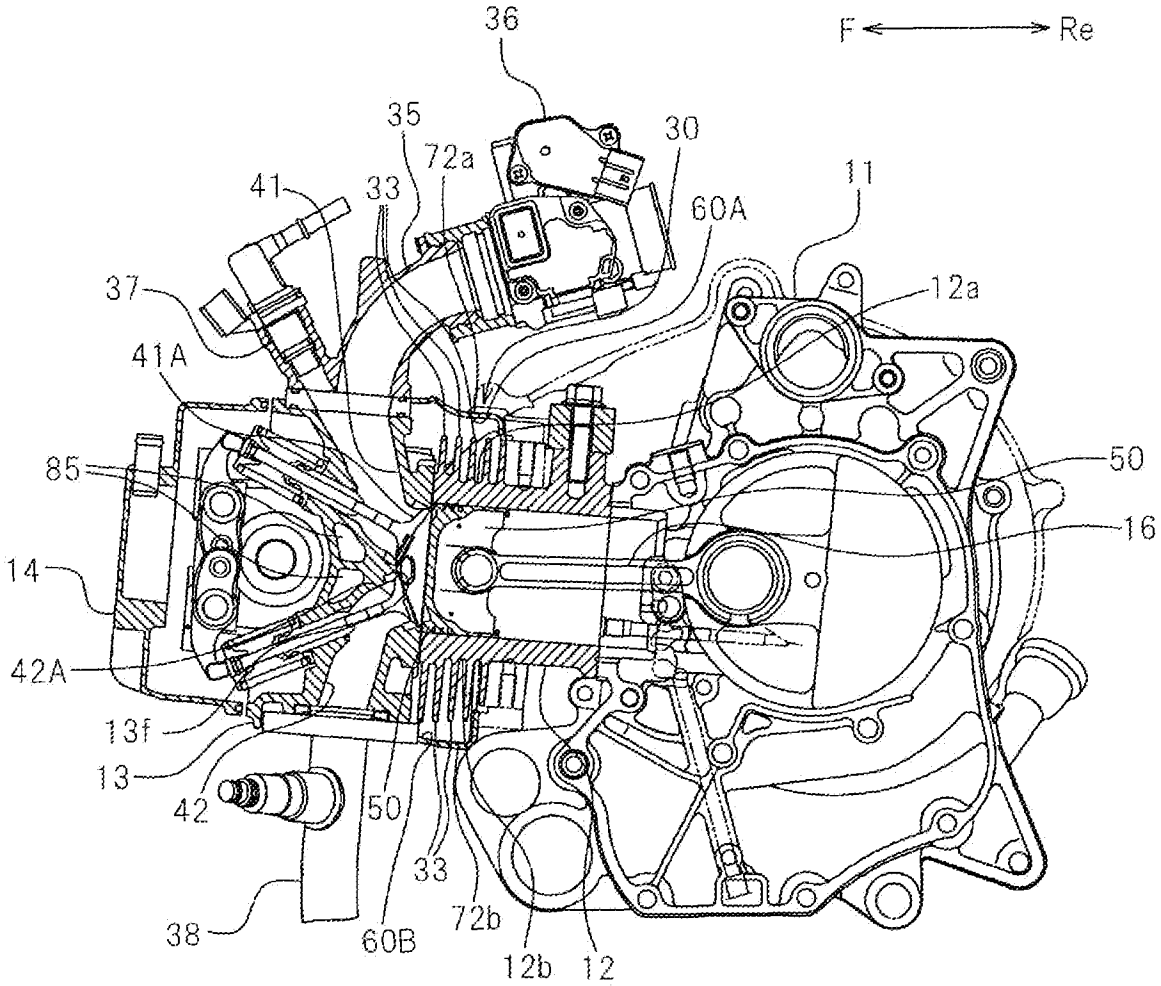
FIG. 11 is a left side cross-sectional view of the engine.
Figure 12:
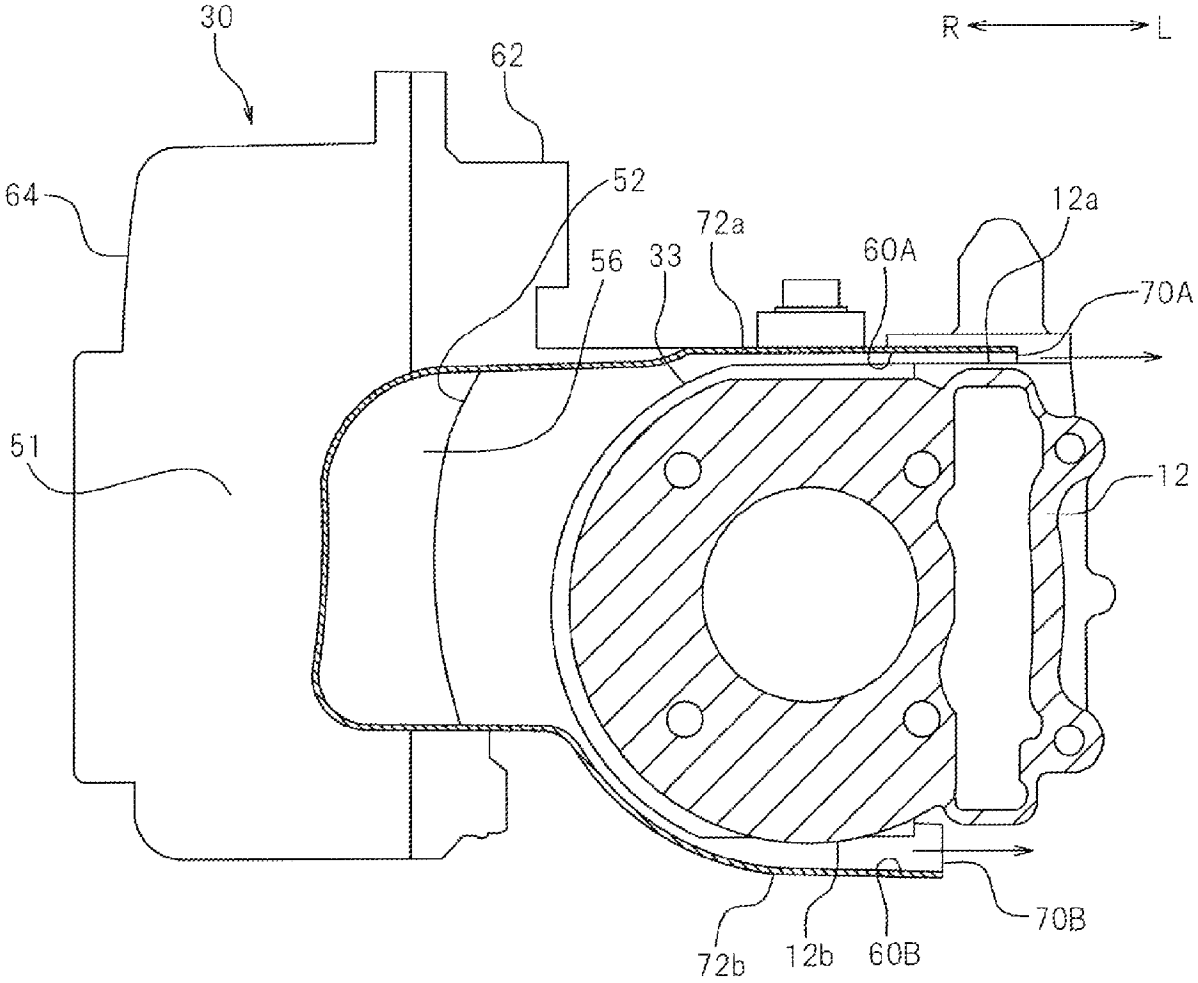
FIG. 12 is a cross-sectional view taken along the line XII-XII of FIG. 4.
Figure 13:
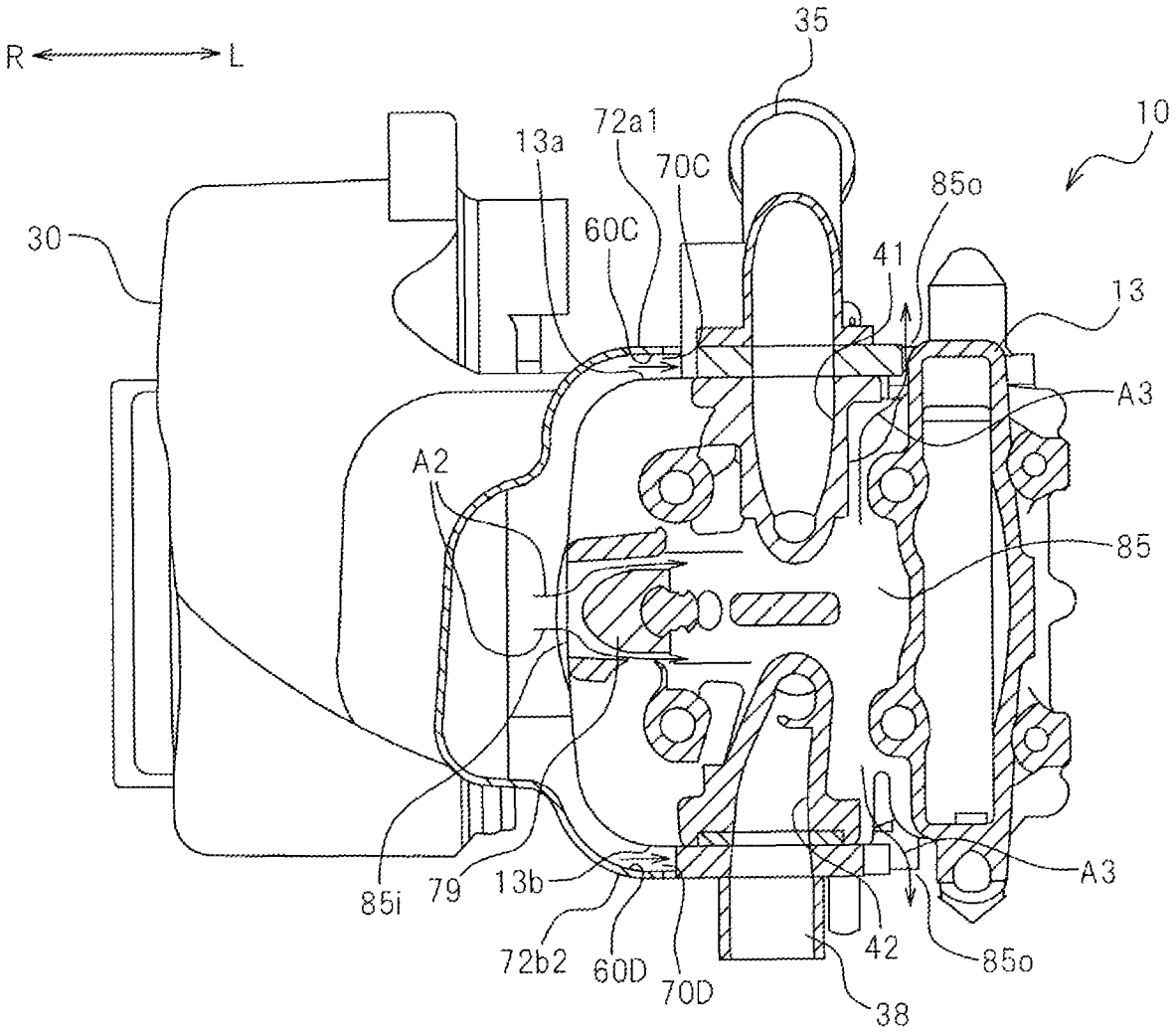
FIG. 13 is a cross-sectional view taken along the line XIII-XIII of FIG. 4.

FIG. 11 is a left side cross-sectional view of the engine 10. FIG. 12 is a cross-sectional view taken along the line XII-XII of FIG. 4. And FIG. 13 is a cross-sectional view taken along the line XIII-XIII of FIG. 4. As illustrated in FIG. 11, the intake pipe 35 is connected with a throttle body 36 including an unillustrated throttle valve. Located forward of the intake pipe 35 is a fuel injection valve 37.

As illustrated in FIG. 11, a plurality of the fins 33 are provided in a region of the cylinder block 12 covered by the shroud 30. Note that the fins 33 may be provided at least in the region of the cylinder block 12 covered by the shroud 30. The providing of a plurality of the fins 33 in a region of the cylinder block 12 not covered by the shroud 30 is optional. As illustrated in FIG. 11, the shroud 30 preferably includes an upper facing wall portion 60A facing a portion of an upper surface 12*a* of the cylinder block 12, and a lower facing wall portion 60B facing a portion of a lower surface 12*b* of the cylinder block 12. Note that the shroud 30 may include a facing wall portion at least facing a portion of the upper or lower surface of the cylinder block 12.

The plurality of fins 33 are provided at surfaces of the cylinder block 12 facing the facing wall portions 60A and 60B. In other words, the plurality of fins 33 are preferably provided at a region of the upper surface 12*a* of the cylinder block 12 facing the facing wall portion 60A, and a region of the lower surface 12*b* of the cylinder block 12 facing the facing wall portion 60B. In the present preferred embodiment, the entire facing wall portions 60A and 60B face the fins 33, but a portion of the facing wall portion 60A or 60B does not necessarily have to face the fins 33. At least a portion of the facing wall portion 60A and/or 60B may face a region of the cylinder block 12 where no fin 33 is provided.

As illustrated in FIG. 11, in the present preferred embodiment, a distance between the facing wall portion 60A of the shroud 30 and the fins 33 of the cylinder block 12 is greater than the interval between the fins 33. A distance between the facing wall portion 60B and the fins 33 is also greater than the interval between the fins 33. Note that the distance between the facing wall portion 60A or 60B and the fins 33 refers to a distance between the facing wall portion 60A or 60B and tips of the fins 33. The interval between the fins 33 refers to an interval between tip portions of the fins 33.

Figure 14:
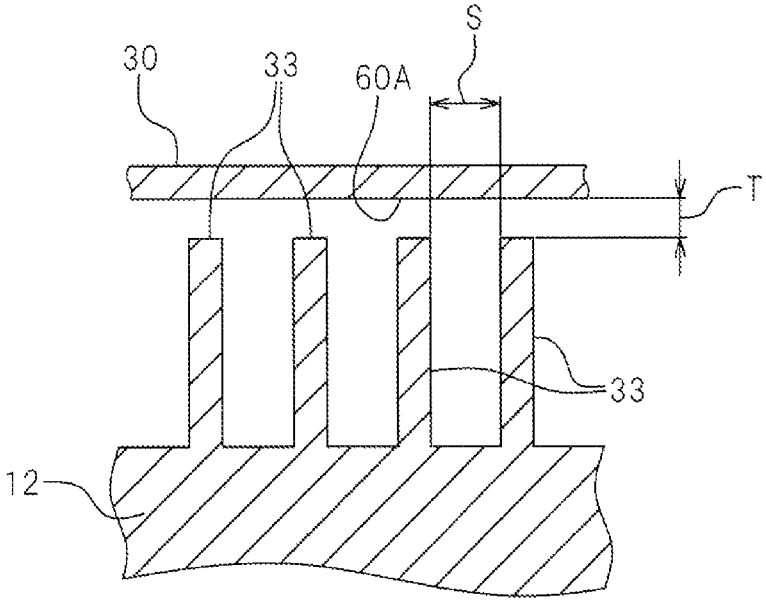
FIG. 14 is a cross-sectional view illustrating a facing wall portion of the shroud and a cylinder block according to a variation of the first preferred embodiment of the present invention.

It is to be noted that as illustrated in FIG. 14, a distance T between the facing wall portion 60A and the fins 33 may be smaller than an interval S between the fins 33. Alternatively, the distance T between the facing wall portion 60A and the fins 33 may be equal to the interval S between the fins 33. Although not illustrated, the distance between the facing wall portion 60B and the fins 33 may be similarly smaller than the interval between the fins 33, or equal to the interval between the fins 33. The distance between the facing wall portion 60A and the fins 33 may be equal to the distance between the facing wall portion 60B and the fins 33. The distance between the facing wall portion 60A and the fins 33 may be smaller or greater than the distance between the facing wall portion 60B and the fins 33. Note that the foregoing relationship T<S may be established for all the fins 33 facing the facing wall portion 60A, or may be established for only some of the fins 33 facing the facing wall portion 60A. The same goes for the fins 33 facing the facing wall portion 60B. Similarly, the other foregoing relationships may be established for all the fins 33 facing the facing wall portion 60A or 60B, or may be established for only some of the fins 33 facing the facing wall portion 60A or 60B.

In the present preferred embodiment, an inner surface region of the upper wall 72*a* (see FIG. 5) of the shroud 30 preferably defines the facing wall portion 60A. As illustrated in FIG. 12, a left end of the upper facing wall portion 60A of the shroud 30 is located rightward of that of the cylinder block 12. Between a left end region of the facing wall portion 60A and the upper surface 12*a* of the cylinder block 12, there is provided an exhaust opening 70A opened leftward. A left end of the lower facing wall portion 60B of the shroud 30 is also located rightward of that of the cylinder block 12. Between a left end region of the facing wall portion 60B and the lower surface 12*b* of the cylinder block 12, there is provided an exhaust opening 70B opened leftward. Some of the air inside the shroud 30 is discharged leftward through the exhaust openings 70A and 70B.

A region of the shroud 30 located rightward of the cylinder block 12 and the cylinder head 13, i.e., a region of the shroud 30 covering a portion of the crankcase 11, a portion of the cylinder block 12 and a portion of the cylinder head 13, will be referred to as a "shroud main body 51". As illustrated in FIG. 12, the upper facing wall portion 60A extends above the cylinder block 12 from the shroud main body 51. The lower facing wall portion 60B extends below the cylinder block 12 from the shroud main body 51.

As illustrated in FIG. 5, the width M1 of the upper wall 72*a* is greater than the width M2 of the lower wall 72*b*. Therefore, the exhaust opening 70A of the upper facing wall portion 60A has a width greater than that of the exhaust opening 70B of the lower facing wall portion 60B. A length of the upper facing wall portion 60A from the shroud main body 51 and that of the lower facing wall portion 60B from the shroud main body 51 are different from each other. In the present preferred embodiment, the length of the upper facing wall portion 60A from the shroud main body 51 is longer than that of the lower facing wall portion 60B from the shroud main body 51. However, the length of the upper facing wall portion 60A from the shroud main body 51 may be shorter than that of the lower facing wall portion 60B from the shroud main body 51. Alternatively, the length of the upper facing wall portion 60A from the shroud main body 51 may be equal to that of the lower facing wall portion 60B from the shroud main body 51.

As illustrated in FIG. 10, the cooling fan 28 is located rightward of the cylinder axis L1 of the cylinder 15, and the exhaust opening 70A is located leftward of the cylinder axis L1 of the cylinder 15. The cooling fan 28 is connected to a right portion of the crankshaft 17, and the exhaust opening 70A is opened leftward. When the cooling fan 28 is located leftward of the cylinder axis L1 of the cylinder 15, the exhaust opening 70A may be located rightward of the cylinder axis L1 of the cylinder 15. When the cooling fan 28 is connected to a left portion of the crankshaft 17, the exhaust opening 70A may be opened rightward. The exhaust opening 70A is located closer to the cylinder head 13 than the bottom dead center BDC of the piston 50 (i.e., forward of the bottom dead center BDC). Although not illustrated, the same goes for the exhaust opening 70B.

As illustrated in FIG. 13, the intake port 41 is preferably provided in an upper portion of the cylinder head 13. The intake port 41 is connected with the intake pipe 35. As illustrated in FIG. 13, the shroud 30 includes an additional facing wall portion 60C in addition to the facing wall portions 60A and 60B. The facing wall portion 60C is provided at a position facing a portion of a surrounding region of the intake port 41 of the cylinder head 13. As already described above with reference to FIG. 5, the protrusion 72*a*1 is preferably provided at the upper wall 72*a* of the shroud 30. The facing wall portion 60C is preferably defined by an inner surface region of the protrusion 72*a*1. As illustrated in FIG. 13, between the additional facing wall portion 60C and the cylinder head 13, there is provided an additional exhaust opening 70C. The additional exhaust opening 70C is arranged so that air is discharged to a periphery of the intake pipe 35. As mentioned above, the left lateral surface 72*a*2 (see FIG. 5) of the protrusion 72*a*1 of the upper wall 72*a* is curved, and is arc-shaped in plan view. Hence, the exhaust opening 70C is arc-shaped. In the cross section illustrated in FIG. 13, the additional exhaust opening 70C is arranged so that air is discharged leftward.

The exhaust port 42 is preferably located in a lower portion of the cylinder head 13. The exhaust port 42 is connected with the exhaust pipe 38. The shroud 30 further includes an additional facing wall portion 60D. The additional facing wall portion 60D is provided at a position facing a portion of a surrounding region of the exhaust port 42 of the cylinder head 13. As already described above with reference to FIG. 5, the lower wall 72*b* of the shroud 30 includes the curved wall 72*b*2. The facing wall portion 60D is preferably defined by an inner surface region of the curved wall 72*b*2. As illustrated in FIG. 13, between the additional facing wall portion 60D and the cylinder head 13, there is provided an additional exhaust opening 70D. The additional exhaust opening 70D is arranged so that air is discharged to a periphery of the exhaust pipe 38. A peripheral edge of the curved wall 72*b*2 (see FIG. 5) is arc-shaped. Hence, the exhaust opening 70D is arc-shaped. In the cross section illustrated in FIG. 13, the additional exhaust opening 70D is formed so that air is discharged leftward.

As illustrated in FIG. 13, in the cylinder head 13, there is provided an air passage 85 having an intake opening 85*i* and exhaust openings 85*o*. The intake opening 85*i* is preferably located in a right region of the cylinder head 13. More specifically, the intake opening 85*i* is preferably arranged laterally of the ignition device 79 (see FIG. 3). The intake opening 85*i* is opened rightward and is arranged so that air is sucked from its right to its left. However, the direction in which the intake opening 85*i* is opened is not limited to any particular direction. The exhaust openings 85*o* are preferably arranged in a left region of the cylinder head 13. The number of the exhaust openings 85*o* is not limited to any particular number. One or a plurality of the exhaust openings 85*o* may be provided. Note that the number of the intake openings 85*i* is also not limited to any particular number. In the present preferred embodiment, the two exhaust openings 85*o* are preferably provided. In this case, the exhaust openings 85*o* are preferably arranged in upper and lower regions of the cylinder head 13. The upper exhaust opening 85*o* is opened upward and is arranged so that air is discharged upward. The lower exhaust opening 85*o* is opened downward and is arranged so that air is discharged downward. However, the direction in which each exhaust opening 85*o* is opened is not limited to any particular direction. Air supplied from the cooling fan 28 flows into the air passage 85 through the intake opening 85*i*. Air A2 flowing in through the intake opening 85*i* flows around the combustion chamber 43 (see FIG. 3), the intake port 41, and the exhaust port 42. This air is discharged through the exhaust openings 85*o* (see the reference signs "A3" in FIG. 13).

Air flows through the air passage 85 as described above, so as to allow air to be supplied to the surrounding regions of the intake and exhaust ports 41 and 42 of the cylinder head 13. Therefore, the surrounding regions of the intake and exhaust ports 41 and 42 of the cylinder head 13 can be efficiently cooled. It is difficult to cover the surrounding regions of the intake and exhaust ports 41 and 42 of the cylinder head 13 by the shroud 30. However, in the present preferred embodiment, the air passage 85 is provided, thus making it possible to efficiently cool the regions having difficulty in being covered by the shroud 30. Accordingly, the cooling of the engine 10 can be further improved.

As illustrated in FIG. 3, the cam chain 98 preferably is located inside the cylinder head 13 and inside the cylinder block 12. The cam chain 98 is wound around a sprocket 99*a* of a camshaft, and a sprocket 99*b* of the crankshaft 17. The cam chain 98 is located leftward of the cylinder 15. The cam chain 98 is connected to a left portion of the crankshaft 17, i.e., a portion of the crankshaft 17 opposite to a portion thereof to which the cooling fan 28 is connected.

Figure 15:
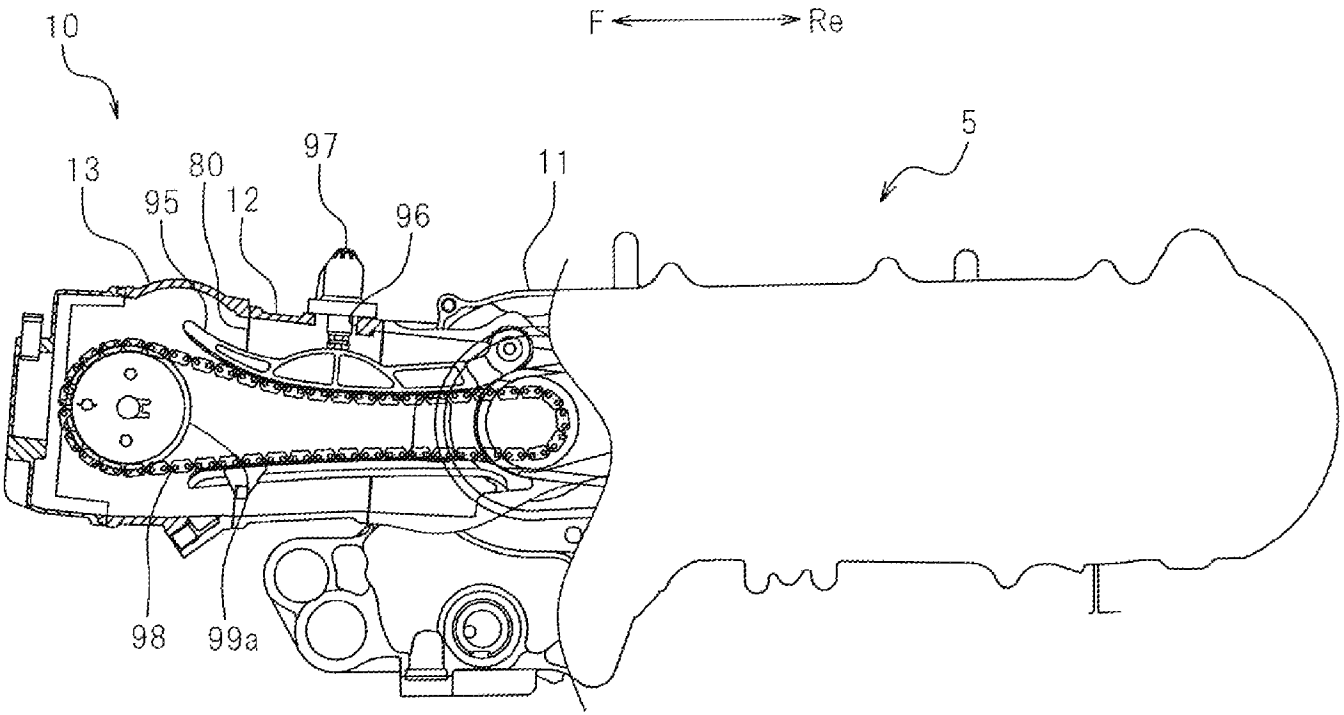
FIG. 15 is a lateral cross-sectional view of a left side portion of the engine.

FIG. 15 is a lateral cross-sectional view of a portion of the engine 10 according to the present preferred embodiment. As illustrated in FIG. 15, in an upper surface of the cylinder block 12, there is provided a hole 96 to which a cam chain tensioner 97 is attached. The cam chain tensioner 97 is inserted into the hole 96. In other words, the cam chain tensioner 97 is inserted into the cylinder block 12. A portion of the cam chain tensioner 97 is exposed to outside of the cylinder block 12. The cam chain tensioner 97 applies tension to the cam chain 98 via a chain guide 95. As illustrated in FIG. 10, the exhaust opening 70A is located closer to the cylinder head 13 than the cam chain tensioner 97 (i.e., above the cam chain tensioner 97 in FIG. 10). The exhaust opening 70A is located forward of the cam chain tensioner 97. Although not illustrated, the exhaust opening 70B is also similarly located closer to the cylinder head 13 than the cam chain tensioner 97. The exhaust opening 70B is located forward of the cam chain tensioner 97.

As illustrated in FIG. 3, as an example of a sensor that detects the state of the engine 10, the knock sensor 81 that detects knocking is located in the cylinder block 12. Upon occurrence of knocking, combustion pressure sharply fluctuates, thus causing peculiar vibrations in the cylinder block 12 and the cylinder head 13, for example. As the knock sensor 81, for example, a sensor that detects a vibration and converts the vibration into an electric signal to output the signal (e.g., a sensor including a piezoelectric element) can be suitably used. However, the knock sensor 81 is not limited to any particular type. As is clear from FIGS. 3 and 10, the exhaust opening 70A is located closer to the cylinder head 13 than the knock sensor 81. The exhaust opening 70A is located forward of the knock sensor 81. Similarly, the exhaust opening 70B is also located closer to the cylinder head 13 than the knock sensor 81. The exhaust opening 70B is located forward of the knock sensor 81. Note that the knock sensor 81 is merely described as an example of the sensor that detects the state of the engine 10, and a sensor other than the knock sensor 81 may naturally be used as the sensor that detects the state of the engine 10.

As indicated by the arrow A in FIG. 3, air outside the shroud 30 is introduced to the inside of the shroud 30 through the suction port 31 upon rotation of the cooling fan 28 in association with rotation of the crankshaft 17. The air introduced to the inside of the shroud 30 flows into the duct 56 through the inlet 56*i*. At some position along the duct 56, the duct 56 includes a flow passage cross-sectional area smaller than that of the inlet 56*i*. Thus, the air is temporarily increased in velocity inside the duct 56 and blown against the cylinder block 12 and the cylinder head 13 through the outlet 56*o*.

The air blown against the cylinder block 12 and the cylinder head 13 is divided into air flowing through a region above the cylinder block 12 and the cylinder head 13 and air flowing through a region below the cylinder block 12 and the cylinder head 13. As illustrated in FIG. 12, air that has reached the region above the cylinder block 12 flows between the facing wall portion 60A of the shroud 30 and the upper surface 12*a* of the cylinder block 12. Since a plurality of the fins 33 are provided at the upper surface 12*a* of the cylinder block 12, the air flows between the fins 33 (see FIG. 11). The air flows leftward between the facing wall portion 60A of the shroud 30 and the upper surface 12*a* of the cylinder block 12, and is then discharged leftward through the exhaust opening 70A.

Air that has reached the region below the cylinder block 12 flows between the facing wall portion 60B of the shroud 30 and the lower surface 12*b* of the cylinder block 12. Since a plurality of the fins 33 are provided at the lower surface 12*b* of the cylinder block 12, the air flows between the fins 33 (see FIG. 11). The air flows leftward between the facing wall portion 60B of the shroud 30 and the lower surface 12*b* of the cylinder block 12, and is then discharged leftward through the exhaust opening 70B.

As illustrated in FIG. 13, a portion of air that has reached the region above the cylinder head 13 flows between the facing wall portion 60C of the shroud 30 and an upper surface 13*a* of the cylinder head 13. The air flows leftward between the facing wall portion 60C of the shroud 30 and the upper surface 13*a* of the cylinder head 13, and is then discharged leftward through the exhaust opening 70C.

A portion of air that has reached the region below the cylinder head 13 flows between the facing wall portion 60D of the shroud 30 and a lower surface 13*b* of the cylinder head 13. The air flows leftward between the facing wall portion 60D of the shroud 30 and the lower surface 13*b* of the cylinder head 13, and is then discharged leftward through the exhaust opening 70D.

Air flows along the peripheries of the cylinder block 12 and the cylinder head 13 as described above, and thus the cylinder block 12 and the cylinder head 13 are cooled by the air.

As mentioned above, a portion of air supplied through the duct 56 flows through the air passage 85 of the cylinder head 13. Thus, a surrounding region of the combustion chamber 43 (see FIG. 3) of the cylinder head 13, a surrounding region of the intake port 41 and a surrounding region of the exhaust port 42 are efficiently cooled.

As described above, in the engine 10 according to the present preferred embodiment, the shroud 30 includes the facing wall portions 60A and 60B facing the fins 33 of the cylinder block 12. The exhaust opening 70A that opens away from the cooling fan 28 is preferably located between the facing wall portion 60A and the cylinder block 12, and the exhaust opening 70B that opens away from the cooling fan 28 is preferably located between the facing wall portion 60B and the cylinder block 12. Air flowing from the shroud main body 51 flows leftward between the facing wall portion 60A of the shroud 30 and the cylinder block 12 and between the facing wall portion 60B of the shroud 30 and the cylinder block 12, and is then discharged leftward through the exhaust openings 70A and 70B, with the flow direction of the air remaining unchanged. Therefore, air can be smoothly discharged, and air resistance can be reduced. Thus, air can be efficiently supplied, and the cooling of the engine 10 can be improved. According to the present preferred embodiment, the periphery of the cylinder block 12 is not entirely covered, thus making it possible to reduce the shroud 30 in size and to prevent an increase in size of the engine 10. Note that air is not supplied to a lateral region of the cylinder block 12 located away from the cooling fan 28, and thus cooling performance for this region is degraded. However, the flow of air is smoothed, thus enhancing cooling performance for the other regions of the cylinder block 12. As a result, degradation in cooling performance is prevented on the whole, or cooling performance is enhanced on the whole.

According to the present preferred embodiment, the crankshaft 17 extends rightward and leftward. The cooling fan 28 is connected to the right end of the crankshaft 17 (see FIG. 3). As illustrated in FIG. 10, the exhaust opening 70A opens away from the cooling fan 28 (i.e., leftward) in a direction parallel or substantially parallel to the crankshaft 17. The same goes for the exhaust opening 70B. Thus, air supplied from the cooling fan 28 can be discharged from a position rightward of the cylinder axis L1 of the cylinder 15 to a position leftward of the cylinder axis L1 of the cylinder 15. As a result, the flow of air inside the shroud 30 can be smoothed.

According to the present preferred embodiment, as illustrated in FIG. 10, the cooling fan 28 is located rightward of the crankcase 11, and the left surface of the cylinder block 12 is not covered by the shroud 30. Since the periphery of the cylinder block 12 does not have to be entirely covered, the shroud 30 can be reduced in size.

According to the present preferred embodiment, as illustrated in FIG. 10, the cooling fan 28 is located rightward of the cylinder axis L1 of the cylinder 15, and the exhaust opening 70A is located leftward of the cylinder axis L1 of the cylinder 15. The same goes for the exhaust opening 70B. Thus, air inside the shroud 30 flows from a position rightward of the cylinder axis L1 of the cylinder 15 to a position leftward of the cylinder axis L1 of the cylinder 15. Air is supplied not only to a region located in the vicinity of the cooling fan 28 but also to a region located away from the cooling fan 28, thus preventing degradation in cooling performance.

Note that as illustrated in FIG. 14, when the distance T between the facing wall portion 60A and the fins 33 is smaller than the interval S between the fins 33 facing the facing wall portion 60A, the flow velocity of air between the facing wall portion 60A and the fins 33 can be increased. Therefore, cooling efficiency of air can be further enhanced.

According to the present preferred embodiment, as illustrated in FIG. 10, the exhaust opening 70A is located closer to the cylinder head 13 than the cam chain tensioner 97. The same goes for the exhaust opening 70B. As illustrated in FIG. 15, in the engine 10 according to the present preferred embodiment, the cam chain tensioner 97 is located at a distance from a connection surface 80 between the cylinder block 12 and the cylinder head 13. The cam chain tensioner 97 is located rearward of the connection surface 80. A region of the cylinder block 12 located in the vicinity of the connection surface 80 is likely to reach a high temperature. Hence, the exhaust openings 70A and 70B are located at the above-described positions, thus making it possible to efficiently cool the region of the cylinder block 12 located in the vicinity of the connection surface 80 in particular.

According to the present embodiment, the exhaust opening 70A is located closer to the cylinder head 13 than the knock sensor 81 (see FIG. 3). The same goes for the exhaust opening 70B. In the engine 10 according to the present preferred embodiment, the knock sensor 81 is preferably located at a distance from the connection surface 80 between the cylinder block 12 and the cylinder head 13. The knock sensor 81 is preferably located rearward of the connection surface 80. As mentioned above, the region of the cylinder block 12 located in the vicinity of the connection surface 80 is likely to reach a high temperature. Hence, the exhaust openings 70A and 70B are located at the above-described positions, thus making it possible to efficiently cool the region of the cylinder block 12 located in the vicinity of the connection surface 80 in particular.

In the present preferred embodiment, the shroud 30 includes, as the facing wall portions, the upper and lower facing wall portions 60A and 60B. Therefore, regions of the fins 33 covered by the shroud 30 are increased. Hence, regions of surfaces of the fins 33 along which the flow velocity of air is high are increased so as to enhancing cooling of the engine 10.

The upper facing wall portion 60A is provided as an example of an intake-side facing wall portion extending from the shroud main body 51 toward the intake port 41 of the cylinder head 13. The lower facing wall portion 60B is provided as an example of an exhaust-side facing wall portion extending from the shroud main body 51 toward the exhaust port 42 of the cylinder head 13. In the present preferred embodiment, as illustrated in FIG. 5, the width of the upper facing wall portion 60A and that of the lower facing wall portion 60B are different from each other; hence, the width of the exhaust opening 70A of the upper facing wall portion 60A and that of the exhaust opening 70B of the lower facing wall portion 60B are different from each other. As described above, the widths of the exhaust openings of the intake-side facing wall portion and the exhaust-side facing wall portion are appropriately selected in accordance with temperature characteristics of the engine 10, thus making it possible to perform cooling in accordance with the temperature characteristics of the engine 10.

Note that the width of the exhaust opening 70A of the upper facing wall portion 60A may be greater or smaller than that of the exhaust opening 70B of the lower facing wall portion 60B. In the present preferred embodiment, the width of the upper facing wall portion 60A is preferably greater than that of the lower facing wall portion 60B, and the width of the exhaust opening 70A of the upper facing wall portion 60A is preferably greater than that of the exhaust opening 70B of the lower facing wall portion 60B. Thus, a larger amount of air can be discharged through the exhaust opening 70A of the upper facing wall portion 60A. Accordingly, when an upper region of the engine 10 (or more specifically, an upper region of the cylinder block 12) reaches a high temperature, the upper region can be efficiently cooled. Note that when a lower region of the engine 10 is more likely to reach a high temperature than the upper region of the engine 10, the width of the exhaust opening 70B of the lower facing wall portion 60B may be made greater than that of the exhaust opening 70A of the upper facing wall portion 60A.

In the present preferred embodiment, as illustrated in FIG. 12, the length of the upper facing wall portion 60A from the shroud main body 51 and that of the lower facing wall portion 60B from the shroud main body 51 are different from each other. When either the upper surface 12*a* or the lower surface 12*b* of the cylinder block 12 of the engine 10 is more likely to reach a high temperature, the upper and lower facing wall portions 60A and 60B preferably have different lengths as described above, thus making it possible to appropriately cool the region of the engine 10 where the temperature is likely to reach a high temperature. In the present preferred embodiment, the length of the upper facing wall portion 60A is longer than that of the lower facing wall portion 60B. Therefore, the upper surface 12*a* of the cylinder block 12 of the engine 10 where the temperature is more likely to reach a high temperature can be cooled more efficiently than the lower surface 12*b*.

In the present preferred embodiment, as illustrated in FIG. 10, the exhaust opening 70A is preferably located closer to the cylinder head 13 than the bottom dead center BDC of the piston 50. The same goes for the exhaust opening 70B. A region of the cylinder block 12 closer to the cylinder head 13 than the bottom dead center BDC of the piston 50 is likely to reach a high temperature. The exhaust openings 70A and 70B are located closer to the cylinder head 13 than the bottom dead center BDC of the piston 50, thus allowing air to be guided to the above-mentioned region. As a result, the cylinder block 12 can be suitably cooled.

In the present preferred embodiment, as illustrated in FIG. 13, the shroud 30 includes the additional facing wall portion 60C facing at least a portion of the surrounding region of the intake port 41 of the cylinder head 13. The cooling fan 28 is located rightward of the intake port 41, and the shroud 30 includes the additional facing wall portion 60C facing a region of the cylinder head 13 located rightward of the intake port 41. Note that when the cooling fan 28 is located leftward of the intake port 41, the shroud 30 may include an additional facing wall portion facing a region of the cylinder head 13 located leftward of the intake port 41. The additional exhaust opening 70C is preferably provided between the facing wall portion 60C and the upper surface 13*a* of the cylinder head 13. Thus, air can be efficiently guided to the surrounding region of the intake port 41 of the cylinder head 13. Accordingly, the cylinder head 13 that is likely to reach a high temperature can be suitably cooled. In addition to the exhaust openings 70A and 70B, the exhaust opening 70C is preferably provided so as to increase the total area of the exhaust openings and making it possible to reduce air resistance.

In the present preferred embodiment, as illustrated in FIG. 13, the shroud 30 includes the additional facing wall portion 60D facing at least a portion of the surrounding region of the exhaust port 42 of the cylinder head 13. The cooling fan 28 is located rightward of the exhaust port 42, and the shroud 30 includes the additional facing wall portion 60D facing a region of the cylinder head 13 located rightward of the exhaust port 42. Note that when the cooling fan 28 is located leftward of the exhaust port 42, the shroud 30 may including an additional facing wall portion that faces a region of the cylinder head 13 located leftward of the exhaust port 42. The additional exhaust opening 70D is preferably located between the facing wall portion 60D and the lower surface 13*b* of the cylinder head 13. Thus, air can be efficiently guided to the surrounding region of the exhaust port 42 of the cylinder head 13. Accordingly, the cylinder head 13, which is likely to reach a high temperature, can be suitably cooled. In addition to the exhaust openings 70A and 70B, the exhaust opening 70D is preferably provided so as to increase the total area of the exhaust openings and making it possible to reduce air resistance.

Other Preferred Embodiments

The engine 10 according to each preferred embodiment described above preferably is a transverse engine in which the cylinder axis L1 extends horizontally or substantially horizontally. However, the direction of the cylinder axis L1 is not limited to a horizontal direction or a substantially horizontal direction. The engine 10 may be a "longitudinal" engine in which the cylinder axis L1 extends substantially vertically. For example, the cylinder axis L1 may have an inclination angle of about 45° or more or an inclination angle of about 60° or more with respect to a horizontal plane in that case.

The engine 10 is not limited to a unit swing type engine that swings with respect to the body frame 9, but may be an engine fixed to the body frame 9 so as not to be swingable.

In each of the foregoing preferred embodiments, the cooling fan 28 preferably is driven by the crankshaft 17. However, the fan for producing an air current is not limited to one driven by the crankshaft 17. For example, a fan driven by an electric motor may be used. Such a fan is equivalent to a cooling fan rotated together with the crankshaft 17, as long as it is driven at least during operation of the engine 10.

Although the preferred embodiments of the present invention have been described in detail thus far, each of the foregoing preferred embodiments has been described by way of example only. The present invention disclosed herein includes diverse variations or modifications of each of the foregoing preferred embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An internal combustion engine comprising:

a crankshaft;

a crankcase supporting the crankshaft;

a cylinder block connected to the crankcase and including an upper surface, a lower surface, and a cylinder provided therein;

a cylinder head superposed on the cylinder block so as to cover the cylinder;

a cooling fan that rotates together with the crankshaft;

a shroud arranged to cover a portion of the crankcase, the cooling fan, a portion of the cylinder block, and a portion of the cylinder head; and a plurality of fins are provided at least in a region of the cylinder block covered by the shroud; wherein the plurality of fins include fins provided at the upper surface of the cylinder block and fins provided at the lower surface of the cylinder block;

the shroud includes an upper facing wall portion that faces the fins provided at the upper surface of the cylinder block and a lower facing wall portion that faces the fins provided at the lower surface of the cylinder block; and an exhaust opening that discharges air to outside of the shroud and opens on a side of the cylinder block that is opposite to a side of the cylinder block that faces the cooling fan, an end of the exhaust opening being provided directly above the upper surface of the cylinder block and between the upper facing wall portion and the upper surface of the cylinder block, or directly below the lower surface of the cylinder block and between the lower facing wall portion and the lower surface of the cylinder block.

2. The internal combustion engine according to claim 1, wherein the cooling fan is connected to one end of the crankshaft, and the exhaust opening opens in a direction parallel or substantially parallel to the crankshaft and toward another end of the crankshaft away from the cooling fan.

3. The internal combustion engine according to claim 1, wherein the crankshaft extends rightward and leftward, and the cooling fan is located rightward of the crankcase and a left surface of the cylinder block is not covered by the shroud, or the cooling fan is located leftward of the crankcase and a right surface of the cylinder block is not covered by the shroud.

4. The internal combustion engine according to claim 1, wherein the crankshaft extends rightward and leftward, and the cooling fan is located rightward of the crankcase and the exhaust opening is located leftward of an axis of the cylinder, or the cooling fan is located leftward of the crankcase and the exhaust opening is located rightward of the axis of the cylinder.

5. The internal combustion engine according to claim 1, wherein the cooling fan is connected to a first end of the crankshaft;

a region of the crankshaft located toward a second end of the crankshaft is connected with a cam chain located inside of the cylinder block and the cylinder head;

a cam chain tensioner that applies tension to the cam chain and is partially exposed to outside of the cylinder block is located inside the cylinder block; and the exhaust opening is located closer to the cylinder head than the cam chain tensioner.

6. The internal combustion engine according to claim 1, further comprising a sensor located in the cylinder block that detects a state of the internal combustion engine, wherein the exhaust opening is located closer to the cylinder head than the sensor.

7. The internal combustion engine according to claim 1, wherein the cylinder head includes an intake port and an exhaust port;

the shroud includes a shroud main body arranged to cover a portion of the crankcase, a portion of the cylinder block, and a portion of the cylinder head;

the upper facing wall portion includes an intake-side facing wall portion extending toward the intake port of the cylinder head from the shroud main body and the lower facing wall portion includes an exhaust-side facing wall portion extending toward the exhaust port of the cylinder head from the shroud main body; and a width of an exhaust opening of the intake-side facing wall portion and a width of an exhaust opening of the exhaust-side facing wall portion are different from each other.

8. The internal combustion engine according to claim 1, wherein the shroud includes a shroud main body arranged to cover a portion of the crankcase, a portion of the cylinder block, and a portion of the cylinder head;

the upper facing wall portion extends above the cylinder block from the shroud main body and the lower facing wall portion extends below the cylinder block from the shroud main body; and a length of the upper facing wall portion from the shroud main body and a length of the lower facing wall portion from the shroud main body are different from each other.

9. The internal combustion engine according to claim 1, further comprising a piston located inside the cylinder and connected to the crankshaft via a connecting rod so as to be movable in a reciprocating manner, wherein the exhaust opening is located closer to the cylinder head than a bottom dead center of the piston.

10. The internal combustion engine according to claim 1, wherein an intake port is located in an upper portion of the cylinder head;

the shroud includes an additional facing wall portion facing at least a portion of a surrounding region of the intake port of the cylinder head; and an additional exhaust opening is located between the additional facing wall portion and the cylinder head.

11. The internal combustion engine according to claim 1, wherein the crankshaft extends rightward and leftward;

an intake port is located in an upper portion of the cylinder head;

the intake port is connected with an intake pipe;

the cooling fan is located rightward of the crankcase and the shroud includes an additional facing wall portion that faces a region of the cylinder head located rightward of the intake port, or the cooling fan is located leftward of the crankcase and the shroud includes an additional facing wall portion facing a region of the cylinder head located leftward of the intake port; and an additional exhaust opening is located between the additional facing wall portion and the cylinder head.

12. The internal combustion engine according to claim 1, wherein an exhaust port is located in a lower portion of the cylinder head;

the shroud includes an additional facing wall portion that faces at least a portion of a surrounding region of the exhaust port of the cylinder head; and an additional exhaust opening is located between the additional facing wall portion and the cylinder head.

13. The internal combustion engine according to claim 1, wherein the crankshaft extends rightward and leftward;

an exhaust port is located in a lower portion of the cylinder head;

the exhaust port is connected with an exhaust pipe;

the cooling fan is located rightward of the crankcase and the shroud includes an additional facing wall portion that faces a region of the cylinder head located rightward of the exhaust port, or the cooling fan is located leftward of the crankcase and the shroud includes an additional facing wall portion facing a region of the cylinder head located leftward of the exhaust port; and an additional exhaust opening is located between the additional facing wall portion and the cylinder head.

14. The internal combustion engine according to claim 1, wherein a distance between the upper facing wall portion and the fins provided at the upper surface of the cylinder block, or between the lower facing wall portion and the fins provided at the lower surface of the cylinder block, is smaller than an interval between the fins facing the upper facing wall portion or the fins facing the lower facing wall portion.

15. A straddle-type vehicle comprising:

the internal combustion engine according to claim 1.

* * * * *